US006273016B1

(12) United States Patent
Gibbs

(10) Patent No.: US 6,273,016 B1
(45) Date of Patent: Aug. 14, 2001

(54) PORTABLE SUPPORT ASSEMBLY FOR WATERCRAFT

(76) Inventor: Ronnie D. Gibbs, 682 Rio Virgin Dr., St. George, UT (US) 84790

( * ) Notice: Subject to any disclaimer, the term of this patent is extended or adjusted under 35 U.S.C. 154(b) by 0 days.

(21) Appl. No.: 09/404,742

(22) Filed: Sep. 24, 1999

Related U.S. Application Data

(60) Provisional application No. 60/101,947, filed on Sep. 25, 1998.

(51) Int. Cl.[7] ..... B63B 21/00

(52) U.S. Cl. ..... 114/230.1; 114/294; 405/1

(58) Field of Search ..... 405/1, 7; 114/230.1, 114/230.15, 230.16, 294; 37/346

(56) References Cited

U.S. PATENT DOCUMENTS

| | | | | |
|---|---|---|---|---|
| 2,536,908 | * | 1/1951 | Chadwick | 37/346 |
| 3,050,880 | * | 8/1962 | Cushing, Sr. | 114/294 |
| 3,579,996 | * | 5/1971 | Edson | 405/1 |
| 4,254,730 | * | 3/1981 | Crenshaw | 114/294 |
| 4,260,282 | | 4/1981 | Dorsey et al. | 405/1 |
| 4,803,942 | | 2/1989 | Dren et al. | 114/219 |
| 5,067,428 | | 11/1991 | Dickerson et al. | 114/230 |
| 5,186,576 | | 2/1993 | Fournier | 405/7 |
| 5,259,694 | | 11/1993 | Byrne | 405/4 |
| 5,267,811 | | 12/1993 | Evans | 405/1 |
| 5,425,322 | | 6/1995 | Ziober | 114/44 |
| 5,460,112 | * | 10/1995 | Travioli | 114/230.1 |
| 5,477,802 | | 12/1995 | Laue | 114/219 |
| 5,501,166 | | 3/1996 | Ziober | 114/230 |
| 5,641,242 | | 6/1997 | Riviere | 405/3 |

FOREIGN PATENT DOCUMENTS

| | | | | |
|---|---|---|---|---|
| 2 086 810 A | * | 5/1982 | (GB) | 405/7 |
| 2 165 190 A | * | 4/1986 | (GB) | 405/7 |

* cited by examiner

*Primary Examiner*—Sherman Basinger
(74) *Attorney, Agent, or Firm*—Pate Pierce & Baird

(57) ABSTRACT

An apparatus for supporting a watercraft in relation to a surface flooring of a body of water includes a support member for supporting the watercraft and an engaging member adapted to be connected to the support member to selectively retain the watercraft in relation to the support member. A securing assembly is operably connected between the support member and the watercraft to provide a compressive loading force therebetween. Preferably, the support member is formed of a substantially rigid construction. The engaging member is adapted to receive the support member in engagement therewith and may be configured to pivotally engage the watercraft. The securing assembly is moveable between a first position and a second position, thus converting a portion of the weight of the watercraft into a compressive load on the support member. The apparatus for supporting a watercraft may also include a retaining member disposed in relation to the support member. The retaining member helps to resist slippage of the support member in relation to the surface flooring of the body of water, when the securing member is disposed in the second position.

34 Claims, 19 Drawing Sheets

PORTABLE SUPPORT ASSEMBLY FOR WATERCRAFT

RELATED APPLICATIONS

This application claims the benefit of U.S. Provisional Patent Application No. 60/101,947, filed on Sep. 25, 1998.

BACKGROUND

1. Field of the Invention

This invention relates to devices for mooring watercraft, and more particularly, to novel docking support assemblies for watercraft which provides a means for avoiding damage (i.e., abrasive scratches to the hull, bow and/or keel) commonly associated with beaching a watercraft.

2. The Background Art

Watercraft such as, for example, boats, jet skis, wave runners, yachts, sailboats, kayaks and canoes are typically formed of aluminum or glass-reinforced plastic composite material (i.e., fiberglass) which can become easily damaged or seriously scratched as a result of forcible impact or collision with sand, gravel, rocks or other obscure objects or debris found in water. Typically, when a watercraft is beached, removed from and/or launched into a body of water, the lowermost portion of the hull of the watercraft (generally encompassing portions of the stem, bow, forefoot, keel and stern) is particularly susceptible to abrasions. Consequently, abrasive damage promotes corrosion and structural weakening of the hull and/or bow of the watercraft. In addition, the bow of a watercraft may procure serious damage as a result of forcible contact with a docking platform when attempting to secure the watercraft thereto.

Traditionally, the keel and bow (inclusive of the stem and forefoot) of a watercraft are formed having a substantially arcuate shape that structurally encourages the hydrodynamic flow of water across the exterior surface of the hull as the watercraft moves through the water. The hydrodynamic performance of a watercraft, however, can be significantly reduced as a result of abrasions in the hull, keel and/or bow of the watercraft. In this regard, serious damage such as, for example, deep scratches, penetration or abrasions in the exterior surface of the hull, keel and/or bow of a watercraft, may generate substantial dragging or suction forces that act against the motion of the immersed watercraft and, more importantly, may significantly affect the overall hydrodynamic performance of the watercraft. Moreover, abrasions in the hull, keel and/or bow of a watercraft will typically necessitate the repair and/or replacement of the hull and those structural features of the body of the watercraft that are functionally affected.

The repair and/or replacement of the hull of a watercraft is customarily costly, and typically sorely inconvenient to the owner. Accordingly, the capacity for protecting the hull, keel and/or bow of a watercraft from abrasive wear and tear, damage and/or deep scratching has encouraged significant concentration within the marine industry as to developing various options for protecting the hull of a watercraft and reducing the cost of repair and maintenance of its exterior surface, while attempting to preserve the inherent monetary value of the watercraft itself.

In order to minimize the abrasions and damage that are normally caused as a result of forcible impact or collision with sand, gravel and/or rocks in association with beaching a watercraft, those skilled in the art developed prior art boat ramps. For example, prior art boat ramps adapted for beaching a boat were developed which comprise a lowermost horizontally disposed bottom wall and a pair of upstanding side walls in converging relationship to each other and having opposite terminal end portions fixedly disposed at maximum spaced relationship to each other to define an entrance opening through which the bow of a boat may be readily entered in order to rest the hull between the upstanding side walls of the boat ramp. The pair of upstanding side walls typically include an angularly configured contacting surface and stepped portions in the wall for supporting the bow of the boat in relation thereto.

In addition, those skilled in the art developed boat landings having a mat preferably formed of neoprene rubber which acts as a base for two solid neoprene rubber support blocks bonded to the base mat. This structural configuration provides a longitudinal spacing for generally introducing the keel of a boat therein during the beaching or landing operation of the boat in relation to the base mat. To provide a non-slip surface in relation to the shoreline, strips of neoprene rubber may be attached along the bottom of the base mat in spaced apart relationship across the exterior surface area of the mat.

Although seemingly useful for their intended purposes, there are several practical disadvantages with prior art boat ramps and landings. For example, a significant disadvantage of prior art boat ramps and landings of the type generally discussed above includes the difficulty associated with beaching the watercraft in relation to the support structures, whereby prior art ramps and landings typically support a majority of the weight of the boat. Similarly, the effort and skill required to beach a watercraft necessitates an appropriate maneuvering speed that is sufficient to force the bow, keel and a portion of the hull of the watercraft onto the surface facing of the ramp or base landing strip. The weight of the watercraft, however, is no longer significantly offset by its buoyancy in the water. Moreover, a strong amount of upward thrust is typically required to lift the watercraft out of the water and into engagement with the ramp or landing, in addition to the upward thrust of force and pushing required to dislodge the watercraft therefrom. As appreciated by those skilled in the art, watercraft have a general tendency to roll onto either of its sides when mountably resting on a ramp or base landing strip, thus ultimately having a portion of the hull of the watercraft supportably disposed on the sandy or rocky shore.

As illustrated by the number of prior patents, efforts are continuously being made in an attempt to remedy the foregoing disadvantages associated with beaching watercraft. For example, those skilled in the art developed mooring devices that include a cradling assembly that is pivotally mounted to a base, wherein the base includes a pair of spaced apart hinged legs engaged to one another by means of a plurality of cross braces and stop members that function to limit the rearward and forward pivotal tilt of the cradling assembly. In particular, when a watercraft moves onto the engaging pads of the two flanges of the cradling assembly, the weight of the watercraft is generally transferred across the center line of the base causing the cradling assembly to pivot forwardly until a structural stop makes contact with a base pivot cross member, thereby restricting further forward motion of the cradle. To limit rearward motion, a structural member is generally provided which engages at least one cross brace, thereby defining the limit of rearward tilt of the pivotal cradling assembly acting thereagainst.

In accordance with another such technique or method for docking a watercraft, those skilled in the art developed watercraft docking/storage devices for lifting a watercraft from a body of water and thus storing the boat in a position above the water next to a floating dock. Prior art watercraft docking/storage devices of this general type usually comprise a stationary frame secured to the side of a floating dock or marina so that the stationary frame extends laterally therefrom. The stationary frame generally includes a pivoting frame attached thereto, wherein the pivoting frame extends into the water to allow for engagement of a watercraft. In operation, a watercraft is maneuvered toward a second end of the pivoting frame and a cabled connection is attached to the front of the watercraft to provide a means for pulling the watercraft up and onto the pivotal frame by means of angled rollers. When the watercraft has been moved far enough forward, the pivoting frame begins to pivot so as to become coplanar with the stationary frame secured to the floating dock, thereby providing a means for docking the watercraft out of the water on both the stationary and pivoting frames. Similarly, prior art watercraft docking/storage devices may incorporate a deployable carriage mounted upon a deck surface within a cradle assembly and movable in a guided path between a stowed and deployed position by means of adjustable support members secured to the carriage, particularly by means of a rotational engagement of rollers inwardly directed within channels of respective side rails.

A meaningful disadvantage of these prior art watercraft docking and storage devices utilized for supportably mounting and/or removing a watercraft from the water is the considerable amount of effort required for pulling, lifting and pivoting the watercraft in order to mount the watercraft on the carriage or pivoting frame to remove the watercraft and the frame assembly from the water. Correspondingly, a user of prior art watercraft docking and/or storage devices will typically have to substantially lift, support and/or pull the carriage or pivoting frame upon which the watercraft is supported from out of the water, while substantially supporting the weight of the watercraft and the support frame in such a manner so as to not cause any damage to the user(s), the boat, the frame assembly or the dock.

In accordance with other such prior art apparatus and techniques for docking watercraft, those skilled in the art further developed boat docking devices comprising a modified H-shaped platform adapted to reside substantially underwater and having two upwardly protruding arms with a cradle member attached to each arm. The cradle members may consist of a piece of redwood covered with a rug material for engaging the opposing sides of a watercraft. A significant disadvantage associated with the use of a textile, fabric or rug material for engaging the sides of a boat is the collection of sand in the fibers of the material which can act as an abrasive with respect to the surface hull and/or keel of the watercraft resting thereagainst. An elongated tongue may also be provided that includes a holding stake disposed at an end opposite its connection to the platform. The holding stake may be driven into the ground at the shoreline of a body of water to provide a means for supportably retaining the H-shaped platform in an upright position. In operation, the forward section of a watercraft is generally disposed between the two cradle members at a water depth sufficient to provide a floatable relationship therebetween. Typically, a rope is then tied between the boat and the ground stake to secure the watercraft to the docking platform.

A significant disadvantage with prior art docking devices having the foregoing structural limitations includes the confined or limited movement of the cradle members in relation to their attachment to the protruding arms of the H-shaped platform. For example, the cradle members are structurally allowed only a small amount of rotational freedom in the direction of their longitudinal axis. This limited freedom of movement in relation to the upwardly protruding arms of the platform generally limits the ability of the cradle members to accommodate various hull configurations without having to manually adjust the pivotal position of the protruding arms in relation to the platform for each supported watercraft.

Another meaningful disadvantage with prior art docking devices involves the potential of damage to a moored watercraft subject to drifting or rocking movement caused by appreciable wave action. Since the weight and balance of the watercraft is generally disposed in relation to only two cradle members and a rope tied to a holding stake at a distance from the support platform, the watercraft may tend to drift from its floatable engagement with the cradle members should the rope become untied or loose or as a result of appreciable wave action acting against the watercraft. Moreover, the use of prior art docking devices are usually limited to the length of the telescoping capacity of the tongue and the height of the ground stake as it relates to providing sufficient strength so as to maintain the watercraft in floatable relation between its cradle members.

While prior art watercraft ramps and landings, as well as prior art docking/storage devices appear generally suitable for their intended purposes, these prior art mooring assemblies nevertheless leave much to be desired from the standpoint of effectiveness of operation, functionality as to universal application, simplicity of construction in relation to their multiplicity of working parts and relatively complex structure, manufacturing costs and generally being severely cumbersome in view of their bulky weight for the purpose of ease of transport. As will be appreciated in this particular art, economic considerations are significant when dealing with the highly competitive marine industry, since relatively complicated devices are frequently found to be commercially impractical. Moreover, even a slight savings in cost may substantially enhance the commercial appeal of a particular component or assembly when considering issues of mass production of the product.

In accordance therewith, it would be desirable to provide an improved portable support assembly for watercraft which realizes the advantages of the prior art devices while at the same time eliminating the disadvantages associated therewith. Such an apparatus for supportably docking a watercraft is disclosed and claimed herein.

BRIEF SUMMARY AND OBJECTS OF THE INVENTION

In view of the foregoing, it is a primary object of the present invention to provide a novel portable support assembly for watercraft comprising a means for avoiding damage (i.e., abrasive scratches in the hull, bow and/or keel) commonly associated with beaching a watercraft.

It is further an object of the present invention to substantially fix or anchor the watercraft in a single location with respect to the surface flooring of the body of water.

It is also an object of the present invention to provide a portable support assembly for watercraft that assists in supporting a portion of the weight of the watercraft and which facilitates a stabilization in the balance of the watercraft disposed in relation thereto to inhibit the rocking forward and backward movement of the watercraft and/or rolling onto either of its sides.

Similarly, it is an object of the present invention to provide a portable support assembly for watercraft having the structural and functional capability of adjusting three dimensionally so as to conform to the configuration of the hull, keel and/or bow of a watercraft, while accommodating for different rises in the hull of a watercraft, and for providing assistance in aligning the center line of the keel with the center of the support assembly.

It is a further object of the present invention to provide a portable support assembly for watercraft that includes a means for rendering both the support assembly and the watercraft substantially stationary in water, such that docking does not require a strong upward thrust of significant force to lift the watercraft out of the water and into engagement with the support assembly.

Additionally, it is an object of the present invention to provide a portable support assembly for watercraft that facilitates greater structural stability to a watercraft supportably disposed in relation thereto and that is lightweight, compact and easy to assemble and disassemble for purposes of portability and storage within a seat compartment of most watercraft.

Moreover, it is an object of the present invention to provide a portable support assembly for watercraft that is effective in operation and commercially practical in view of being economical to manufacture.

Consistent with the foregoing objects, the present invention is directed toward a novel apparatus for supporting a watercraft in relation to a surface flooring of a body of water including a support member for supporting the watercraft and an engaging member adapted to be connected to the support member to selectively retain the watercraft in relation to the support member. A securing assembly is operably connected between the support member and the watercraft to provide a compressive loading force therebetween. The portable support assembly may also include a retaining member for retaining the support member in relation to a surface flooring of the body of water. The retaining member provides a means for resisting slippage of the support member in relation to the surface flooring of the body of water, when the securing member is disposed in a retracted position.

Preferably, the support member is formed having a substantially rigid construction sufficient to support a portion of the weight of a watercraft when operably disposed in relation thereto. In operation, when selectively attached to the engaging member, the support member is oriented in a generally vertical position in relation to the watercraft.

Structurally, the engaging member is adapted to receive the support member in engagement therewith. The engaging member is preferably configured to pivotally engage the watercraft. In one presently preferred embodiment, the engaging member is adapted to engage at least a section of the hull or the bow of the watercraft, or any other portion of the watercraft suitable for connecting the engaging member, wherein the weight of the watercraft is sufficient to apply a compressive force to the support member.

The securing assembly is moveable between a first (extended) position and a second (retracted) position, thereby converting a portion of the weight of the watercraft into the compressive load or force acting on the support member. Preferably, the securing assembly may include a tension adjuster configured to enable a user to select what portion of the weight of the watercraft is converted into a compressive load on the support member.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
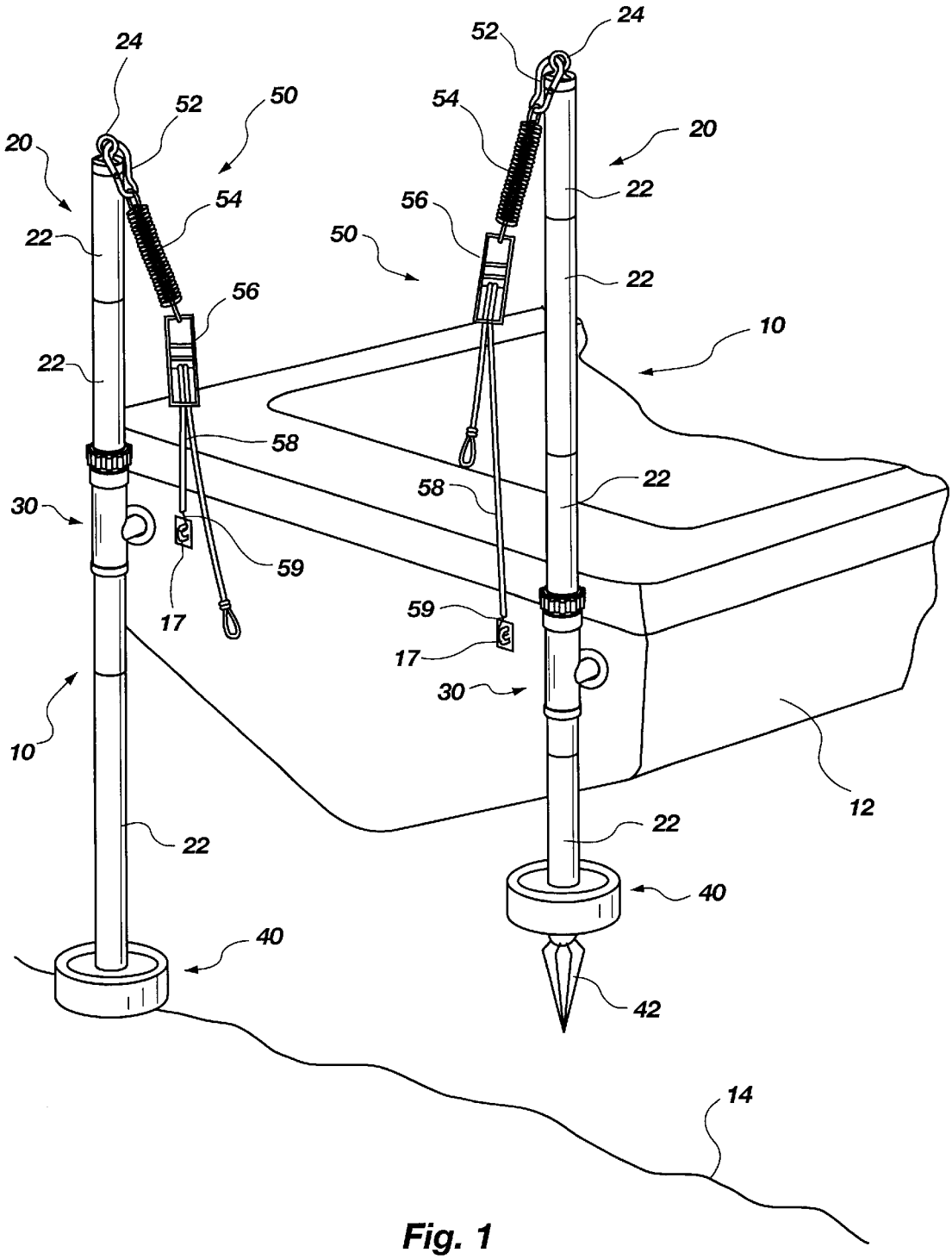
FIG. 1 is a perspective view of a portable support assembly for watercraft in accordance with one presently preferred embodiment of the present invention.

It will be readily understood that the components of the present invention, as generally described and illustrated in the Figures herein, could be arranged and designed in a wide variety of different configurations. Thus the following more detailed description of the embodiments of the system and method of the present invention, as represented in FIGS. 1 through 19, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout One presently preferred embodiment of the present invention, designated generally at 10, is best illustrated in FIGS. 1–6. As shown, the portable support assembly for watercraft 10 comprises a support member 20 for supporting the watercraft 12, an engaging member 30 that may be connected to the support member 20 for securing the watercraft 12 to the support member 20 and a securing assembly 50 operably connected to the watercraft 12 and configured to compressively load the support member 20. The portable support assembly 10 may include a retaining member 40 for retaining the support member 20 in relation to a surface flooring 14 of the body of water.

The portable support assembly 10 may be employed in a landing area of a body of water, such as a beach area. The weight of the watercraft 12, as it is transferred through the securing assembly 50 to the support member 20, may urge either the support member 20 or, if present, the retaining member 40 into engagement with the surface flooring 14 of a body of water. The engaging member 30 preferably connects the support member 20 in relation to the watercraft 12 and thereby renders both the watercraft 12 and the portable support assembly 10 substantially stationary in relation to the underlying surface flooring 14 of the body of water.

As best shown in FIG. 1, the support member 20 comprises a generally straight member having a substantially rigid construction sufficient to support a portion of the weight of a watercraft 12. In one presently preferred embodiment, the support member 20 comprises a modular construction having one or more modular members 22 connected together by any suitable means known to those skilled in the art, such as a twisting lock, screw threads or the like. The modular construction of the support member 20 enables a user to adjust the length of the support member 20 by simply adding or removing modular members 22 and, thus, to select the water depth in which the portable support assembly 10 will be used. The modular construction of the support member 20 also enables a user to easily stow the portable support assembly 10 in one or more storage compartments available on most watercraft 12.

Alternatively, the support member 20 may comprise telescoping members disposed in telescopic engagement, wherein one member slides within the other and is secured in a fixed position at a desired length by locking pins, retractable nubs or other conventional means well known in the art. The use of telescoping members provides adjustability in the length of the support member 20, thus enabling a user to select the depth of water in which the portable support assembly 10 is used and to compactly stow the support member 20 in available storage compartments.

Preferably, the cross sectional shape of the support member 20 is substantially circular. As will be appreciated by those skilled in the art, the cross sectional shape of the support member 20 may alternatively be square, triangular or any other suitable regular or irregular geometrical shape consistent with the other structurally related or engaging components from which a portable support assembly 10 is constructed.

A support fastener 24 may be provided to connect the support member 20 to the securing assembly 50. The support fastener 24 may constitute an eye hook or any other suitable structure for connecting the support member 20 to the securing assembly 50. A retaining member 40 may be connected to the support member 20 for retaining the support member 20 in relation to a surface. The retaining member 40 may be connected to the support member 20 by means of screw threads or may alternatively be connected to the support member 20 using a twisting lock or other suitable fastening means known to those skilled in the art.

The support member 20 is preferably formed of a suitable material having the general qualities and characteristics of being significantly immutable to deterioration caused as a result of continuous immersion in a liquid environment in which the present invention is operated. The support member 20 may be formed of any suitable sufficiently sturdy and resilient polymeric or composite material (e.g., plastic, fiberglass, etc.) or any other suitable material, being preferably corrosion resistant, such as stainless steel, aluminum, titanium.

Figure 2:
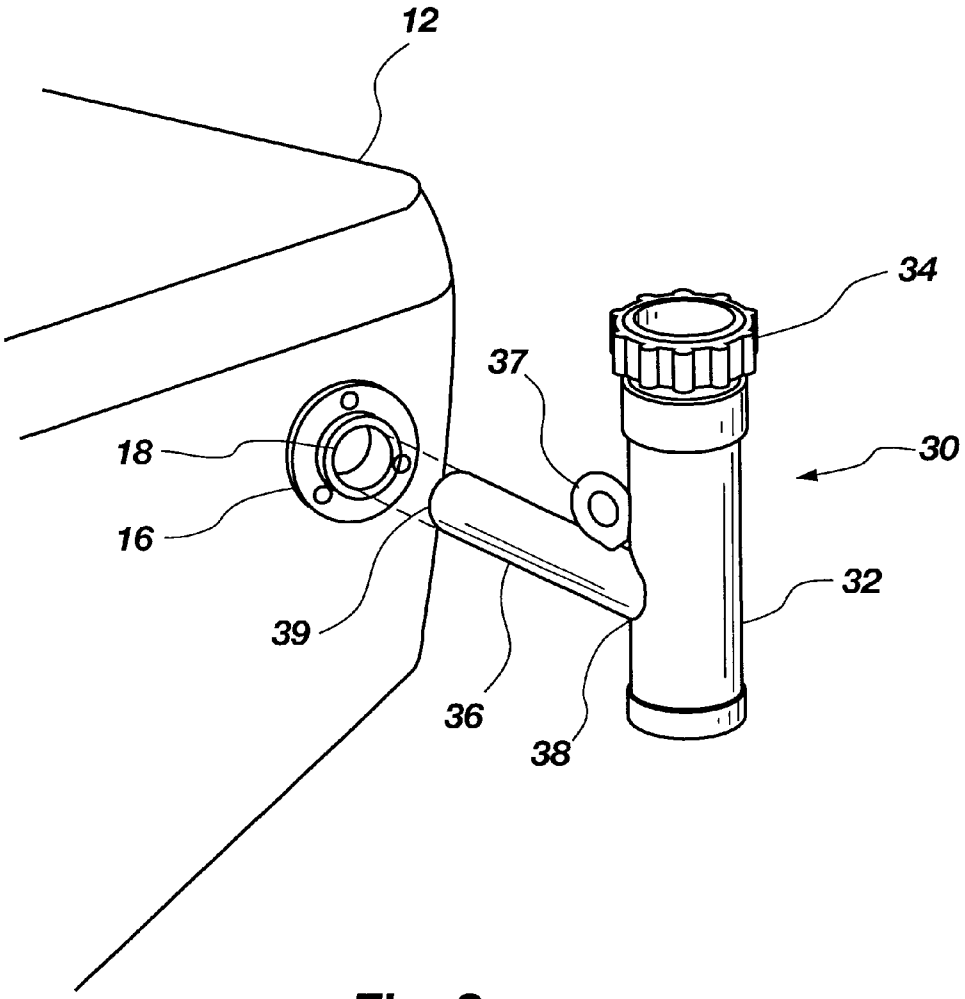
FIG. 2 is an exploded perspective view of the embodiment of FIG. 1 illustrating the relationship between an engaging member and a corresponding mount on the watercraft.

As shown in FIGS. 1 and 2, the engaging member 30 preferably engages the support member 20 in such a manner to provide a securing relationship between the support member 20 and the watercraft 12. In one presently preferred embodiment of the present invention, the engaging member 30 comprises a main body 32, a fixation member 34, an engaging arm 36 and a securing finger 37, as best illustrated in FIG. 2. The main body 32 preferably comprises a structure for receiving the support member 20 therethrough in slidable engagement therewith. For example, the main body 32 may comprise a tubular member. Structurally, the shape of the main body 32 corresponds to the cross sectional shape of the support member 20 so as to accommodate a slidable engagement therebetween. In addition, the main body 32 may include an internal sleeve (i.e., UHMW, polyethylene, nylon, or the like) to cut down on the abrasive wear on the tube.

The fixation member 34 typically constitutes a threaded fitting which functions to constrict the cross sectional area of the main body 32 of the engaging member 30 to fix the length of the support member 20 at a specific location in relation to the main body 32 of the engaging member 30. A user typically employs the fixation member 34 to fix the support member 20 at a substantially vertical position corresponding to a determinable depth to which the support member 20 extends substantially downward below the water surface. The fixation member 34 thus enables a user to control the depth of the water in which the portable support assembly 10 is employed for retaining a retaining member 40 in relation to a surface flooring 14, as best shown in FIG. 1. The fixation member 34 also enables a user to raise the support member 20 from engagement with the floor 14 of the body of water and to fix the support member 20 at some height above the surface flooring 14 suitable for operation of the watercraft. The fixation member 34 further facilitates disassembly of the portable support assembly 10 by enabling a user to lift the support member 20 from contact with the floor 14 and fix the support member 20 at some height above the floor 14, while disconnecting the engaging member 30 from the watercraft 12.

The engaging arm 36 preferably has a proximate end 38 rigidly connected to the main body 32 and a distal end 39 adapted to be secured in a mounting aperture 18 of a watercraft mount 16. The watercraft mount 16 may be of any suitable construction sufficient to mount the engaging arm 36 of the engaging member or any other conventional mounts used to connect peripheral devices to watercraft, which are known to those skilled in the watercraft art. The mount 16 is preferably located in a section of the stern of the watercraft, but may also be located in relation to any portion of the watercraft 12, such as the sides of the hull or the bow, suitable for connecting the engaging member 30 and using the weight of the watercraft to apply a compressive force to a support member 20 connected to the engaging member 30. Preferably, the engaging arm 36 is pivotally connected to the watercraft mount 16 using any of a variety of engagement means well known to those skilled in the art, such as a quick-release, locking pins, (e.g., push buttons), male and female fitting, twisting lock, screw threads or the like. Alternatively, the engaging arm 36 may be rigidly connected to the watercraft mount 16, thus providing a permanent fixture.

As appreciated by those skilled in the art, multiple engaging members 30 may be employed, as described above, in cooperation with the support member 20 in the case of larger watercraft, such as house boats, yachts or sea going vessels of any size.

In one presently preferred embodiment, the securing finger 37 comprises a structural "eye hook" configuration that is fixedly connected, such as by welding or permanent bonding, near the proximate end 38 of the engaging arm 36. The securing finger 37 is formed of rigid, sufficiently sturdy construction to enable the securing finger 37 to remain connected to the securing assembly 50 while under a substantial load acting against the securing finger 37 by means of its connection in relation to a securing assembly 50.

Figure 4:
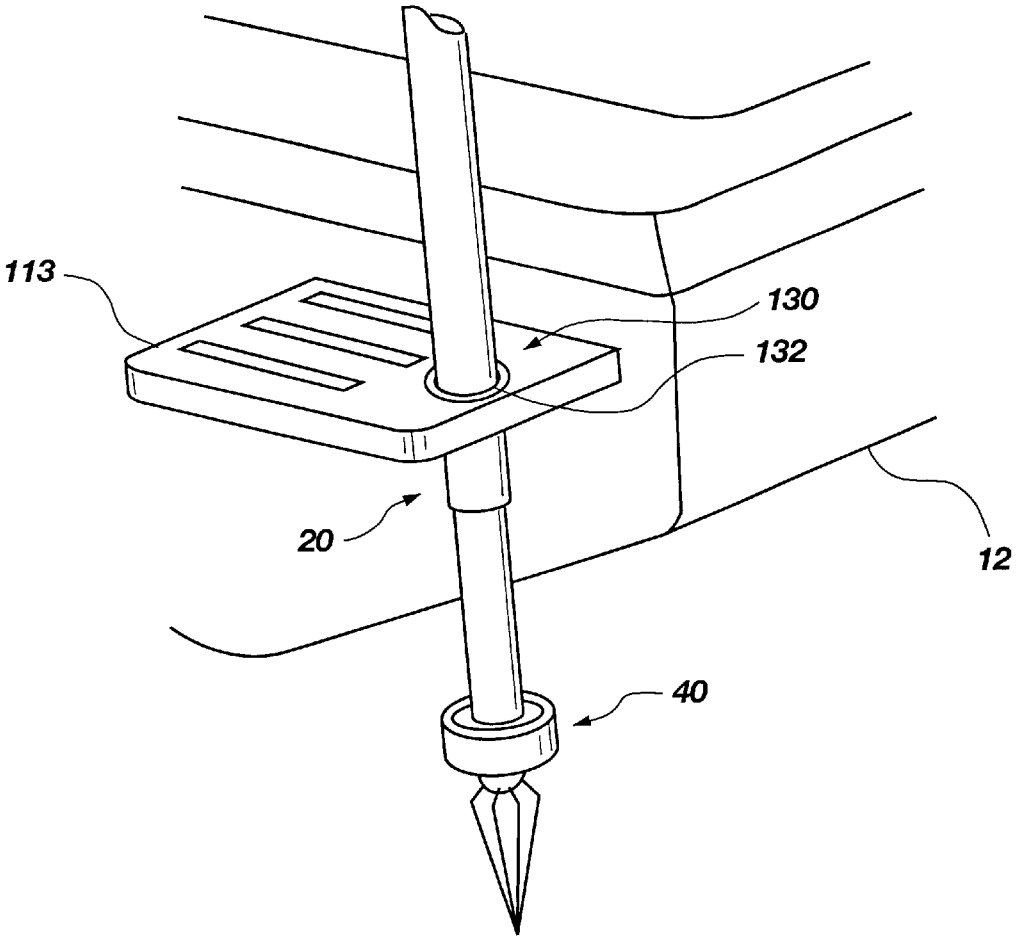
FIG. 4 is a perspective view illustrating another presently preferred embodiment of the engaging member.

Referring now to FIG. 4, an alternate preferred embodiment of the watercraft engaging member 130 is shown. The engaging member 130 is formed in a swimming platform 113 or other platform connected to a watercraft 12. The engaging member 130 may comprise a retaining aperture 132 mounted in a portion of the swimming platform 113 which is adapted to receive the support member 20 therethrough. Functionally, the engaging member 130 is disposed in slidable engagement with the support member 20, but may alternatively facilitate a pivotal or fixed engagement there between.

Figure 5:
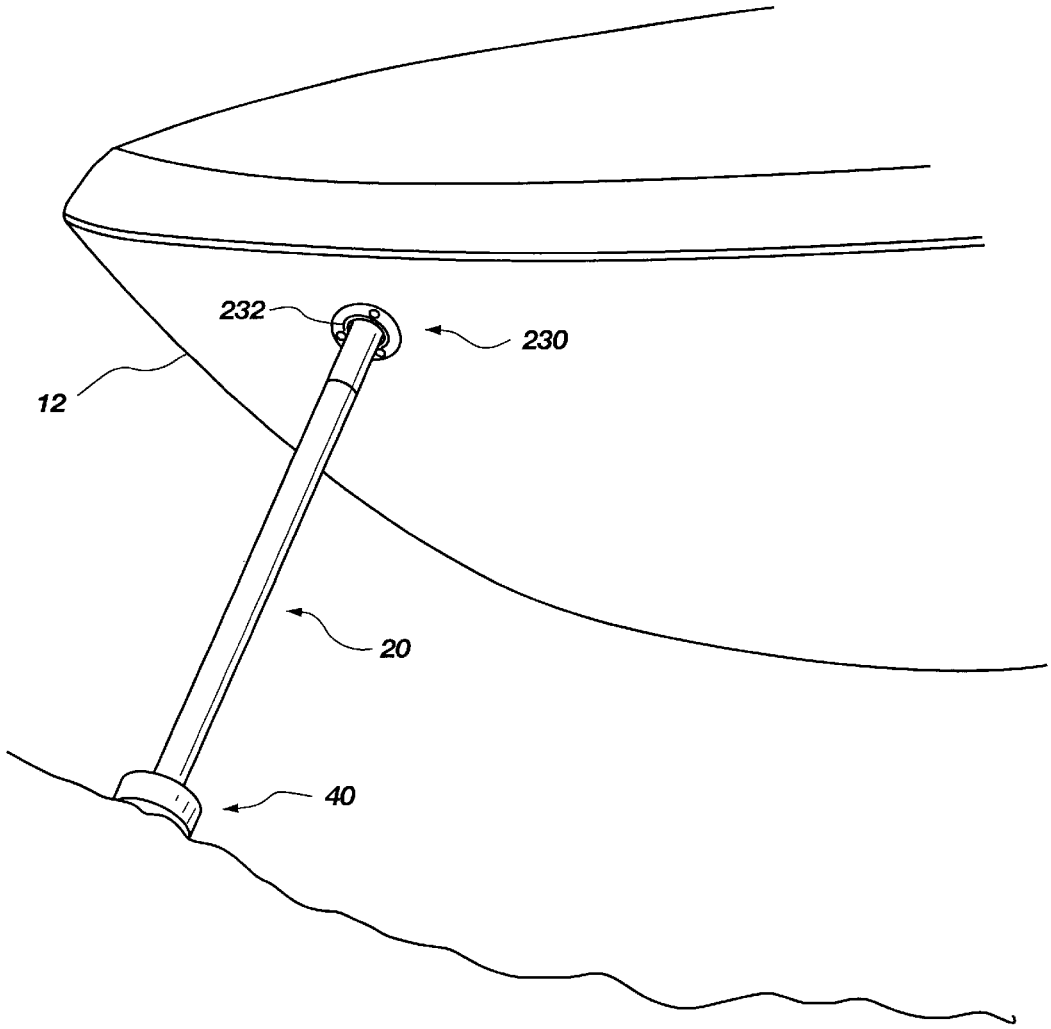
FIG. 5 is a perspective view illustrating yet another presently preferred embodiment of the engaging member formed in the bow of the watercraft and its relationship with a support member.
Figure 6:
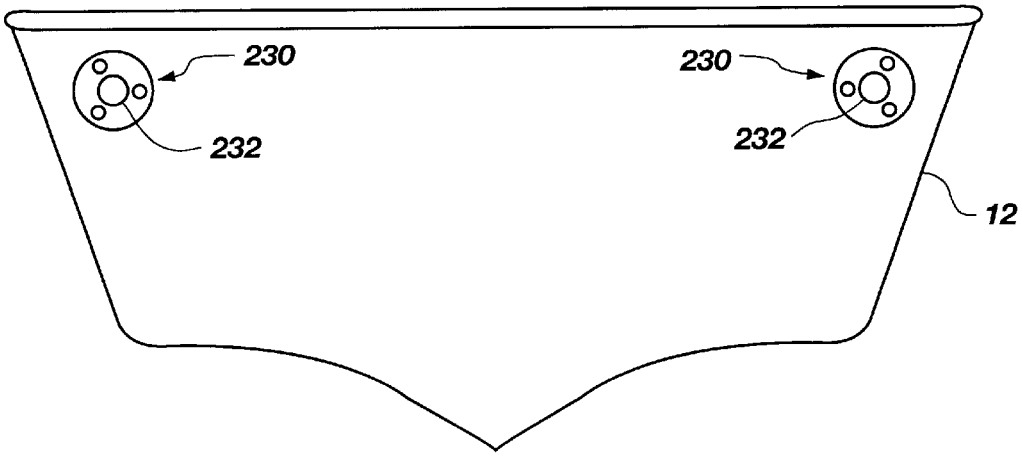
FIG. 6 is a perspective view of the engaging members of the embodiment of FIG. 5 shown to in relation to a watercraft.

As illustrated in FIGS. 5 and 6, another presently preferred embodiment of a watercraft engagement member 230 is shown. The engaging member 230 comprise a retaining aperture 232 mounted in a portion of the body of the watercraft and adapted to receive an engaging end of the support member 20. The engaging member 230 is preferably connected in pivotal engagement with the support member 20, but may alternatively facilitate a slidable or fixed engagement. In one presently preferred embodiment, the engaging member 230 is formed in a portion of the bow of the watercraft 12 as shown in FIG. 5 or, in the alternative, a portion of the stern of the watercraft as shown in FIG. 6.

In one presently preferred embodiment, the engaging member 230 is mounted in the watercraft 12 at about a thirty (30) degree down angle to facilitate the pivotal engagement with the support member 20. Preferably, the engaging member 230 is mounted in the watercraft at a down angle of between twenty (20) degrees and sixty (60) degrees for proper engagement of the support member 20 with the engaging member 230.

Based on the foregoing, it will be readily apparent that other mechanisms for engaging the watercraft 12 may be constructed in accordance with the inventive principles set forth herein. It is intended, therefore, that the examples provided herein be viewed as exemplary of the principles of the present invention, and not as restrictive to a particular structure for implementing those principles.

As illustrated in FIG. 1, a retaining member 40 may be attached to one end of the support member 20. In one presently preferred embodiment, the retaining member 40 is rigidly connected to the support member 20 and an integral part thereof. The retaining member 40 may be formed comprising a variety of configurations that are sufficient to provide positive engagement with the surface flooring 14 of a body of water so as to restrict slippage of the portable support assembly 10 in relation to the flooring 14 (e.g., sand, mud, rock and/or a mixture of the same).

To assist in restricting slippage, the retaining member 40 may formed comprising an insertion spike, an angular tipped surface, a flanged tip, a concave foot, a spade, a wheel or any other suitable shape sufficient to decrease slippage. Alternatively, the retaining member 40 may include an assembly that folds compactly for storage and unfolds or expands to form a significantly larger dimensional footprint for improved contact with the surface flooring 14 of the body of water. Structurally, the retaining member 40 may be formed of any suitable material such as rubber, titanium, stainless steel, aluminum, or any sufficiently rigid polymeric or composite material (e.g. plastic, fiberglass, etc.).

Based on the foregoing, it will be readily apparent that other mechanisms for restricting slippage between the portable support assembly 10 of the present invention and the surface flooring 14 of the body of water may be constructed in accordance with the inventive principles set forth herein. It is intended, therefore, that the examples provided herein be viewed as exemplary of the principles of the present invention, and not as restrictive to a particular structure for implementing those principles.

Figure 3:
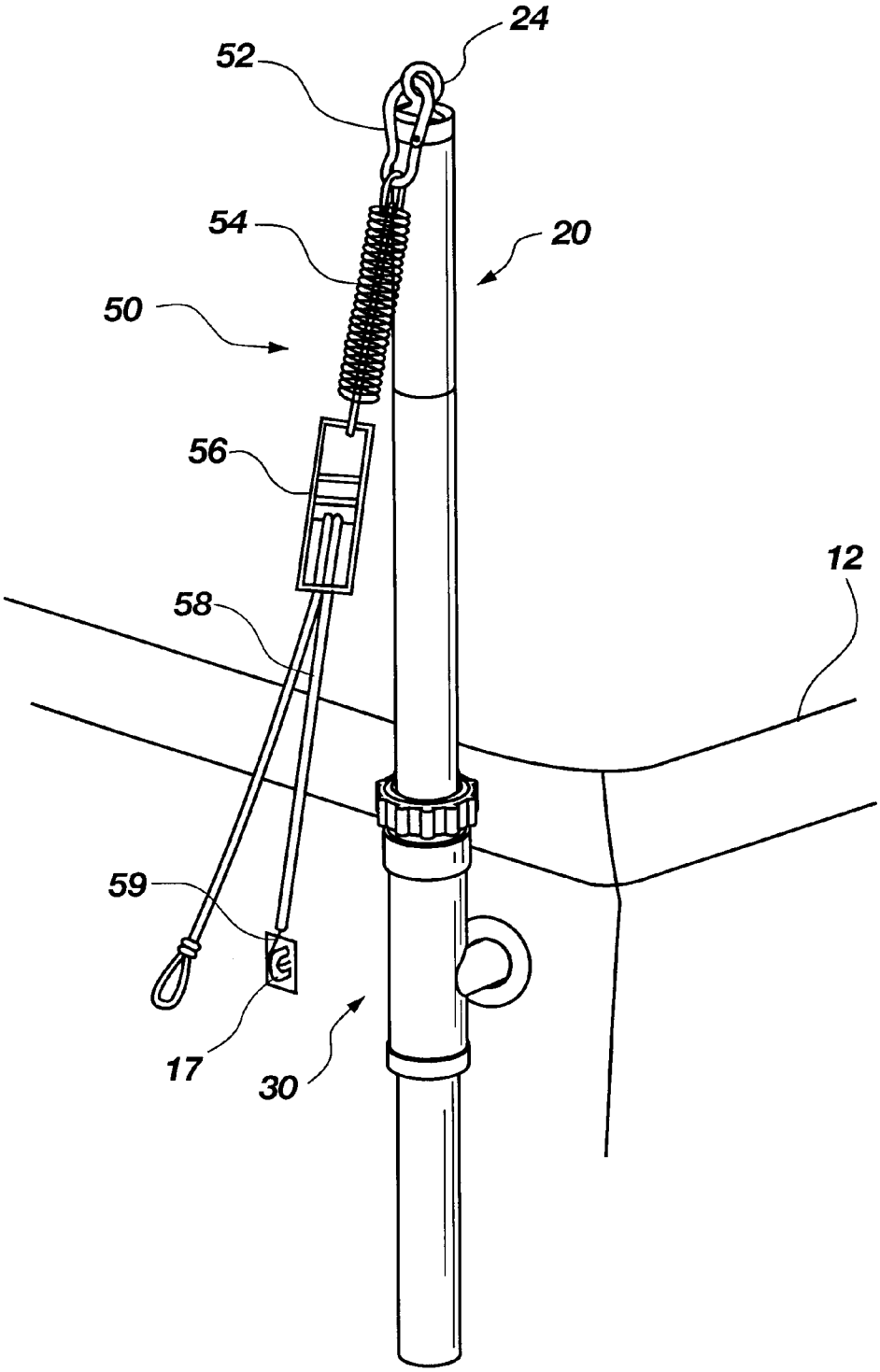
FIG. 3 is a perspective view of the embodiment of FIG. 1 showing a securing assembly and its relationship to both the watercraft and a support member.

As best shown in FIGS. 1 and 3, the securing assembly 50 of one presently preferred embodiment of the present invention is adapted to be moveable between a first position and a second position. The securing assembly 50 may be formed including a securing connector 52, a biased spring 54, a fixing bracket 56 and a securing strap 58 having a securing hook 59 disposed at a leading end. The securing connector 52 may comprise a fastener having a hinged side for connecting the securing connector 52 to the support fastener 24 of the support member 20. As will be appreciated by those skilled in the art, any conventional fastener suitable for connecting the securing assembly 50 to the support member 20 is possible. In one presently preferred embodiment, the spring 54 is preferably connected between the securing connector 52 and the fixing bracket 56 to provide a biasing member. In preferred operation, the biasing spring 54 functions to impart a constant dynamic force (through the securing connector 52 and the support fastener 24) to the support member 20, thus urging the support member 20 and the retaining member 40 substantially downward into engagement with the surface flooring 14 of the body of water.

Preferably, the fixing bracket 56 is structurally disposed between the spring 54 and the securing strap 58 thereby providing a connection between the biasing spring 54 and the strap 58. In this regard, the fixing bracket 56 is adapted to functionally cooperate with the securing strap 58. In particular, the fixing bracket 56 generally receives at least a portion of the securing strap 58 in engagement therewith along a length of the securing strap 58 at a location selected by a user. In use, the securing strap 58 is selectively disposed between the fixing bracket 56 and the securing hook 59. The securing hook 59 may alternatively be connected to a securing mount 17 connected directly to a watercraft 12 or the securing finger 37 of the engaging member 30, as best shown in FIGS. 1, 2 and 3. As will be appreciated, the securing strap 58 may be formed comprising a strap of any suitable length or construction such that the strap is sufficiently sturdy to support the operable engagement between the securing assembly 50 and the support member 20.

In operation, the components of the securing assembly 50 may be connected together as described above. The securing connector 52 may then connected to the support fastener 24, and the securing hook 59 may then be connected to the securing mount 17 connected to the watercraft 12 or to the securing finger 37 of the engaging member 30. With all of the components connected together, a user may selectively adjust the fixing bracket 56 from a first position, which is an extended position, along the extent of the securing strap 58 to a second position, which is a retracted position, thus using the weight of the watercraft to create a compressive load on the support member 20.

A presently preferred alternate embodiment of the securing assembly 50 as contemplated herein comprises tie down straps and resistive bungee cords. Tie down straps may be connected between the support fastener 24 of the support member 20 and the securing mount 17 and one or more bungee cords may be connected to the tie down straps to provide a dynamic resistant force, during operation, for urging the support member 20 and the retaining member 40 into engagement with the surface flooring 14 of the body of water. Large watercraft may incorporate winches (manual, electrical, hydraulic, etc.) or the like having sufficient capacity to create the necessary compressive force, as will be appreciated by those skilled in the art.

As will be appreciated by those skilled in the art, the securing assembly 50 may comprise any device or combination of resistant devices operable to use the weight of the watercraft 12 to apply a compressive load to the support member 20. Based on the foregoing, other resistive mechanisms for securing the watercraft 12 to the portable support assembly 10 may be constructed in accordance with the inventive principles set forth herein. It is intended, therefore, that the examples provided herein be viewed as exemplary of the principles of the present invention, and not as restrictive to a particular structure for implementing those principles.

Referring again to FIG. 1, one presently preferred embodiment of the portable support assembly for watercraft 10 is modular and collapsible for portability and storage within a seat compartment or other storage compartment of a watercraft. Alternate embodiments of the portable support assembly 10 of the present invention can be adapted, if desired, to have one or more of the various components of the support assembly 10 permanently mounted to the watercraft.

Consistent with the foregoing, the adjustable functionality of the portable support assembly 10 of the present invention provides a means for supporting various bow and keel configurations. As is readily apparent, the preferred embodiments of the present invention illustrated in FIGS. 1–6 can be configured to be operable with various bow rises that are commonly found in watercraft. In this regard, the portable support assembly 10 may be configured for use with many types of watercraft from small pleasure watercraft to large seagoing vessels. The cross sectional dimension of the support members 20 therefore may range from about three fourths of an inch (¾") for personal watercraft to about two inches (2") for pleasure boats to about three to five inches (3"–5") or house boats. The support members are typically hollow having walls ranging from about one eighth of an inch (⅛") for use with personal watercraft to about three fourths of an inch (¾") for house boats.

As appreciated by those skilled in the art, the dimensional scale of the portable support assembly 10 may be increased or decreased correspondingly to accommodate large or small water which would in turn increase or decrease the range of adjustability of the support members 20. For example, the scale of the portable support assembly 10 could be increased to accommodate much larger watercraft, such as house boats, yachts or sea going vessels of any size. It is intended, therefore, that the examples disclosed in relation to scale, dimension and/or range in size as provided herein be viewed as exemplary of the principles of the present invention, and not as restrictive to a particular structure for implementing those principles.

As shown in FIG. 1, one presently preferred embodiment of the present invention employs two portable support assemblies 10 disposed in spaced apart relationship to each other to fixedly secure a watercraft 12 with respect to a surface flooring 14 of a body of water. It will be appreciated, however, that dependent on the size of the watercraft, one or more portable support assemblies 10 may suffice for adequately mooring the watercraft in relation to the surface flooring of the body of water.

To employ the portable support assembly 10, as depicted in FIGS. 1–4, the support member 20 is connected to the engaging member 30, 130 and fixed at the desired depth in relation to the watercraft 12. The watercraft 12 is then moved toward shore until the retaining member 40 engages the floor surface of the body of water. With the retaining member 40 in engagement with the floor surface, the securing assembly 50 is moved from its first position to its second position, thereby compressively loading the support member 20 and thus urging the retaining member 40 into a substantially fixed engagement with the surface flooring 14 of the body of water.

In preferred operation, to disengage the watercraft from the portable support assembly 10, the securing assembly is simply moved from its retracted position to its extended position, thereby releasing the compressive load from the support member 20 and the retaining member 40. After raising the support member 20 from engagement with the surface flooring 14, the fixation member 34 may be used to fix the support member 20 at a suitable height above the surface flooring 14 to facilitate the movement of the watercraft without completely disassembly of the portable support assembly 10. The components of the portable support assembly 10 may then be disconnected and stowed, if desired, in an available storage compartment on the watercraft 0. The engaging member 230 depicted in FIGS. 5 and 6 may be employed in a similar manner, except that no securing assembly is employed to compressively load the support member 20 and the retaining member 240, which generally results in a reduced retained engagement between the surface flooring 14 and the retaining member 40.

An alternate preferred embodiment of the present invention, designated generally at 310, is illustrated in FIGS. 7–15. As shown, the portable support assembly for watercraft 310 comprises a frame 320 including a main body 360 and support members 370 for supporting the watercraft 12, a hull engagement assembly 330 for supportably engaging the watercraft 12, and a securing assembly 350 operably disposed in relation to the frame 320 for maintaining the hull 313 of the watercraft 12 in engagement with the hull engagement assembly 330. The portable support assembly for watercraft 310 can be employed in a landing area such as a beach area. The weight of the watercraft 12, as it rests upon the hull engagement assembly 330, serves to anchor the portable support assembly 310 to the floor surface of the body of water, thereby rendering both the watercraft 12 and the portable support assembly 310 stationary.

In preferred construction, the frame 320 further comprises a main body 360 and support members 370, disposed at opposing ends of the main body 360. Preferably, the frame 320 may be formed having a first side 321 being disposed substantially parallel to a second opposing side 323, thereby providing a generally longitudinal alignment therebetween. In one presently preferred embodiment of the present invention, because the first side 321 and the second side 323 of the frame 320 are relatively constructed having a substantially comparable structure and configuration, only the first side 321 will be operatively disclosed in detail herein. Whereas, any structural variations(s) that exist between the first side 321 and the second opposing side 323 will be further disclosed, whereby noting such variation(s).

Figure 7:
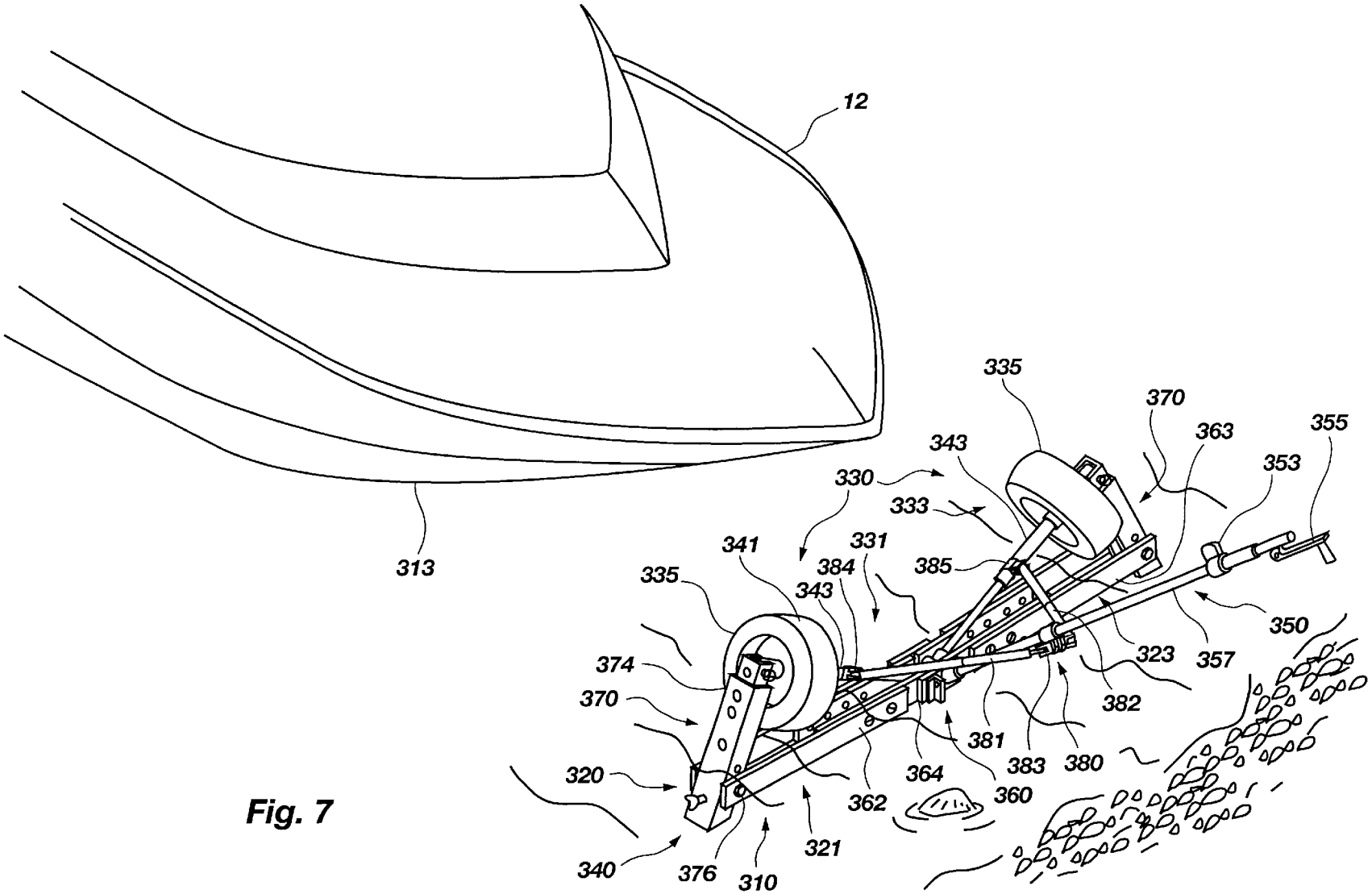
FIG. 7 is a perspective view of a portable support assembly for watercraft in accordance with another presently preferred embodiment of the present invention.
Figure 8:
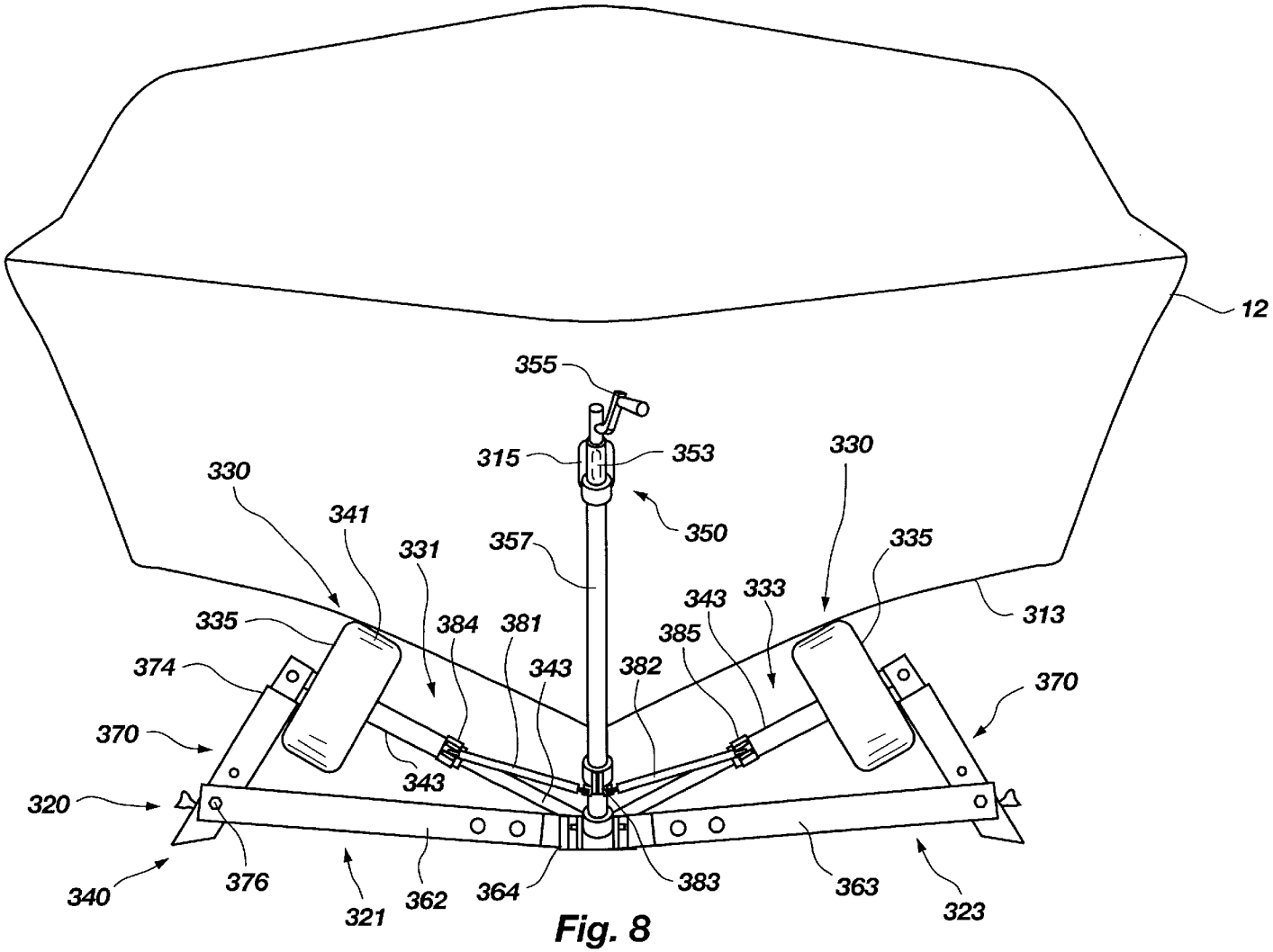
FIG. 8 is an elevation view of the embodiment of FIG. 7 illustrating contact between the watercraft and the support assembly.
Figure 9:
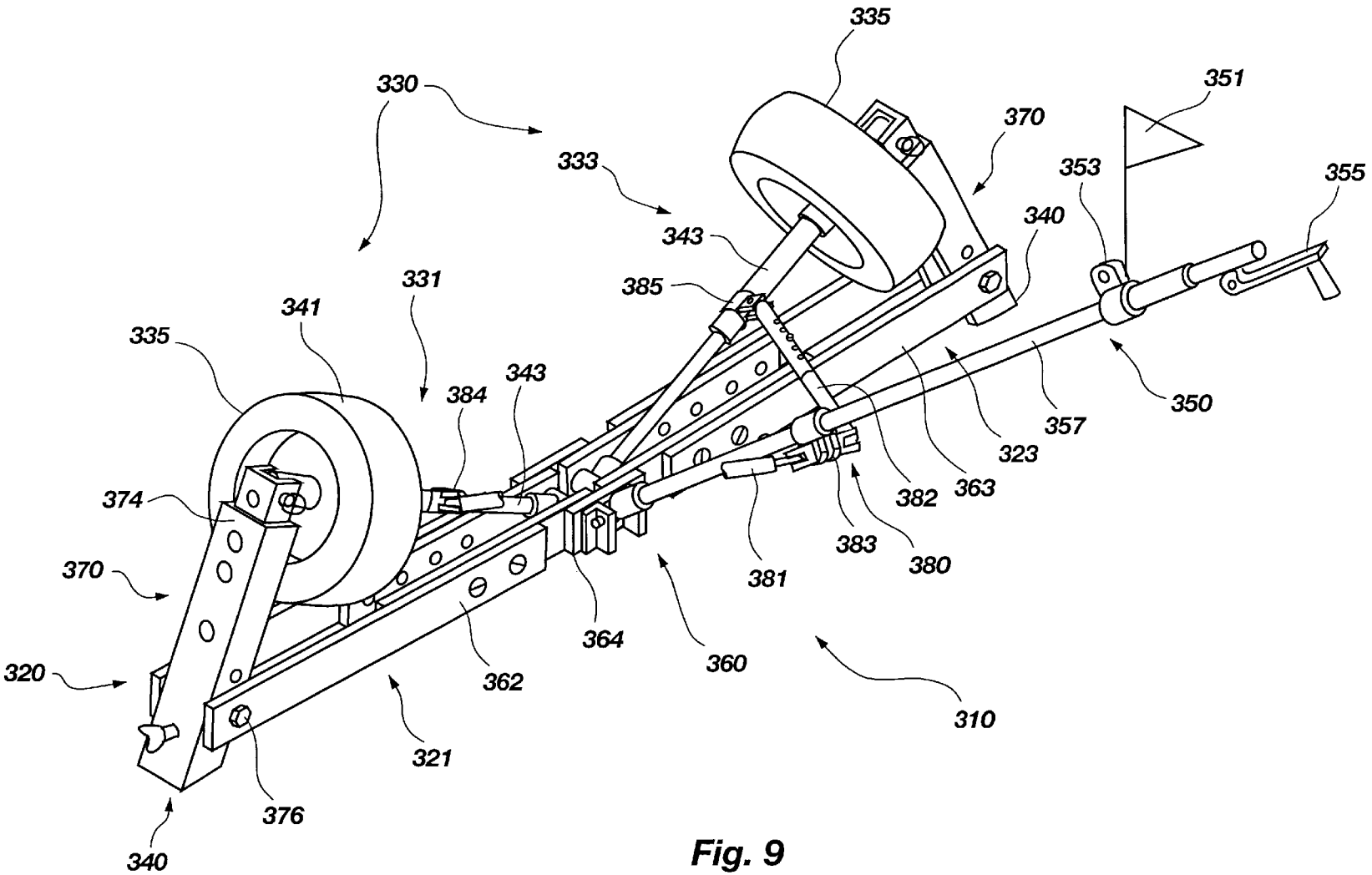
FIG. 9 is an exploded view of the embodiment of FIG. 7 illustrating the arrangement of structural components.
Figure 10:
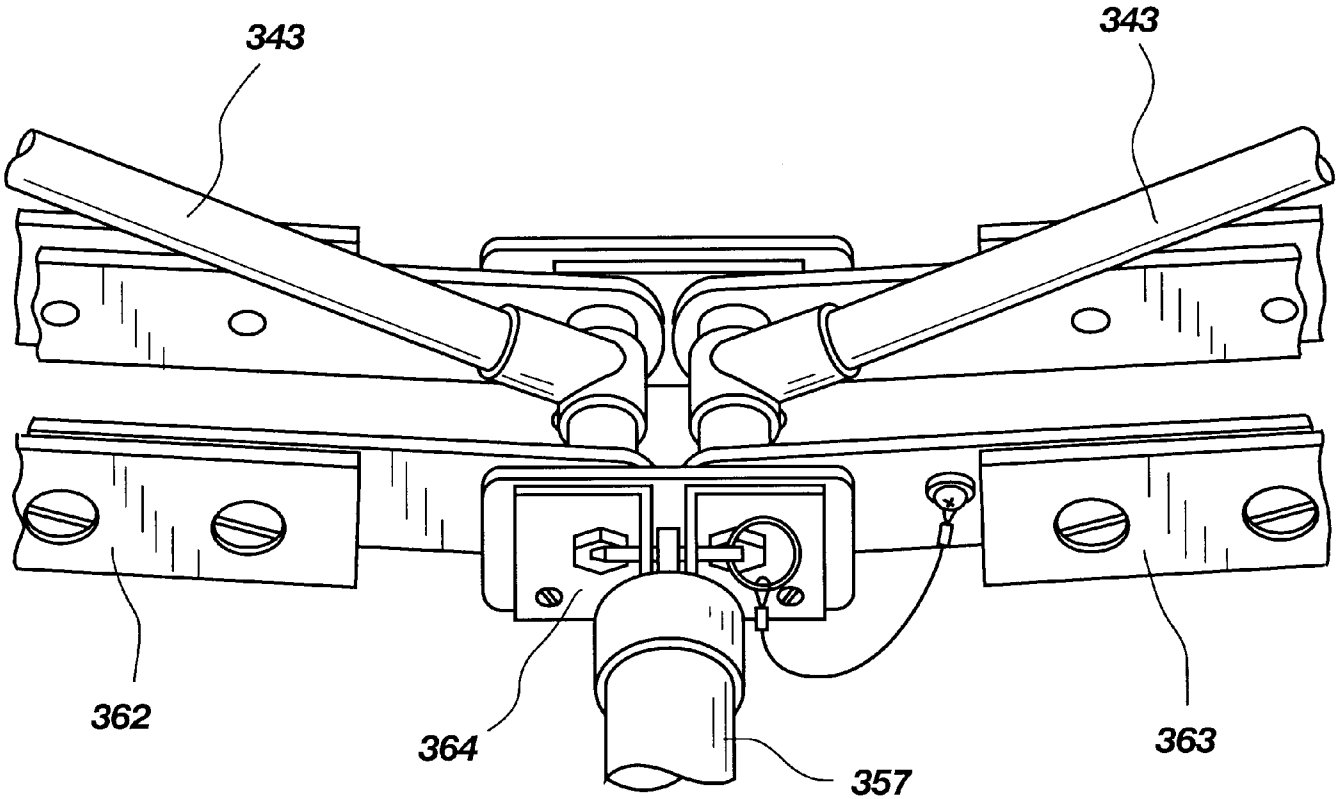
FIG. 10 is a perspective view of the embodiment of FIG. 7 showing the attachment of members at the inner end portions of the main body sections and the pivotal relationships therebetween.
Figure 11:
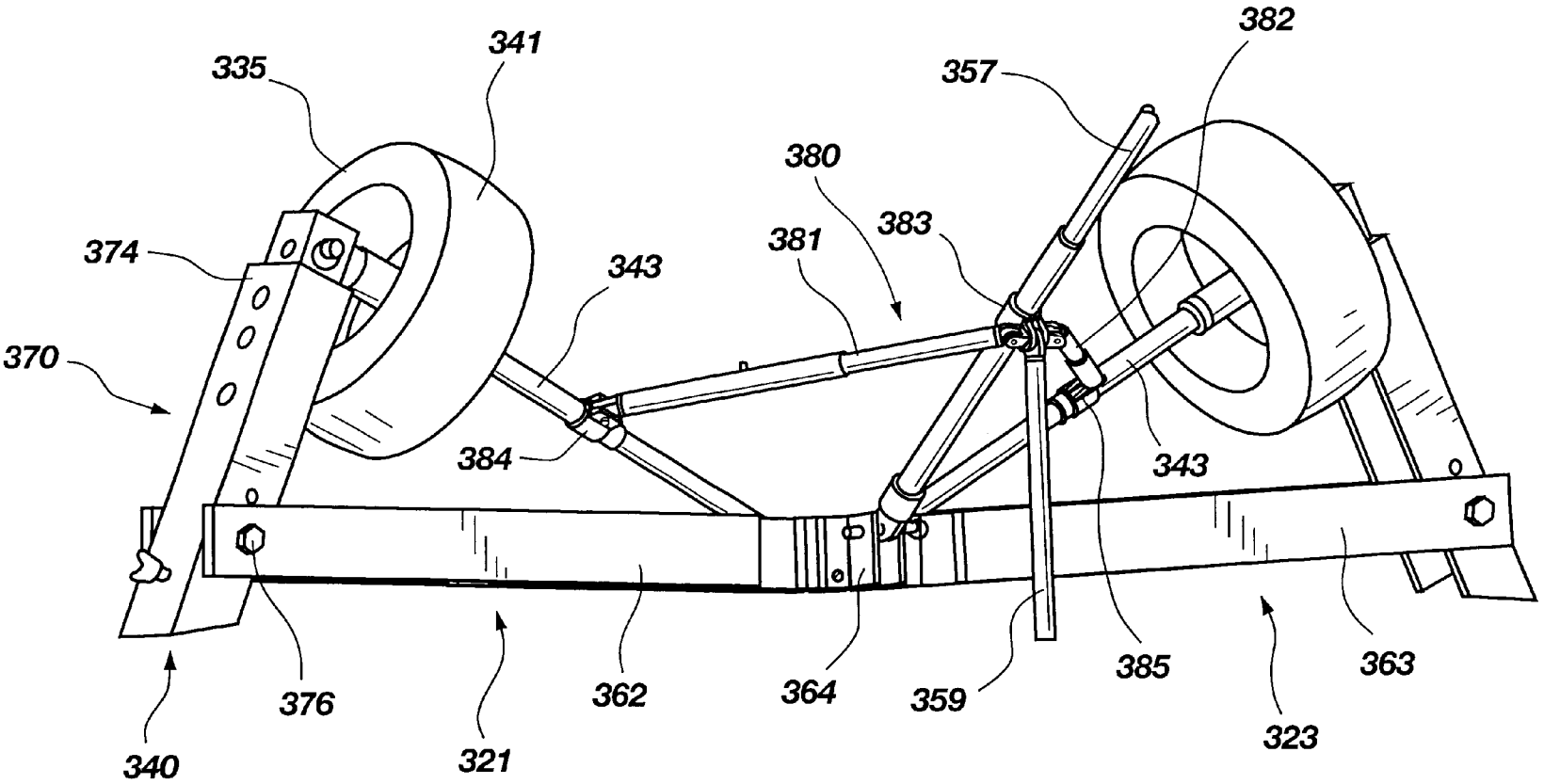
FIG. 11 is a perspective view of the embodiment of FIG. 7 with the securing assembly cut away to illustrate the relationships among the adjustment members, the tongue and the crossbar members.

As shown in FIGS. 7–9, the first side 321 of the frame 320 comprises a main body section 362 and an support member 370. The support member 370 may be pivotally connected to the main body section 362 at a pivotal connection point 376. Both the support member 370 and the main body section 362 are preferably adjustable in length. For example, telescoping members may be provided that can slide relative to one another providing adjustability in the height and width, respectively, of the first side 321 of the frame 320.

A portion of the support member 370 may extend beyond the pivotal connection point 376 to form a retaining member 340 for restricting slippage of the portable support assembly 310 in relation to the surface flooring 14 (e.g., sand, mud, rock and/or a mixture) of a body of water. To assist in restricting slippage relative to the surface flooring 14 of the body of water, the retaining member 340 may comprise a spike tip, an angular tip, a flange tip, a concave tip, a flat tip, a spade tip, or other suitable shape. Additionally, the retaining member 340 may be formed of any suitable material such as rubber, titanium, stainless steel, or any sufficiently rigid polymeric or composite material (e.g. plastic, fiberglass, etc.). Based on the foregoing, it will be readily apparent that other mechanisms for restricting slippage may be constructed in accordance with the inventive principles set forth herein. It is intended, therefore, that the examples provided herein be viewed as exemplary of the principles of the present invention, and not as restrictive to a particular structure for implementing those principles.

In another preferred embodiment of the frame 320, the support member 370 terminates at the pivotal connection point 376, and the main body section 362 may rest directly on the surface flooring 14 of the body of water or a retaining member 340, as disclosed hereinabove, may optionally be fixedly connected to the main body section 362 to further assist in restricting slippage relative to the floor surface of the body of water.

The frame 320, including the main body 360 and the support members 370, are preferably formed of a suitable material having the general qualities and characteristics of being significantly immutable to deterioration that can be caused as a result of continuous immersion in a water environment in which the present invention is operated. The main body 360 may comprise a suitable rigid and strong material, preferably corrosion resistant, such as I-beam, channel, or angle steel members painted or coated with a protective polymer, or anodized. For example, the material comprising the main body 360 and support members 370 may be formed of stainless steel, aluminum, titanium or any suitable, sufficiently rigid polymeric or composite material (e.g., plastic, fiberglass, etc.).

As shown in FIGS. 7–12, the hull engagement assembly 330 may be adapted to be connected to the support members 370. In a presently preferred embodiment, the hull engagement assembly 330 further comprises engaging members 335 and crossbar members 343. An engaging member 335 may comprise a roller 335. Preferably, the hull engagement assembly 330 may be formed having a first side 331 being disposed substantially parallel to a second opposing side 333, thereby providing a generally longitudinal alignment therebetween. In one presently preferred embodiment of the present invention, because the first side 331 and the second side 333 of the hull engagement assembly 330 are relatively constructed having a substantially comparable structure and configuration, only the first side 331 will be operatively disclosed in detail herein. Whereas, any structural variations (s) that exist between the first side 331 and the second opposing side 333 will be further disclosed, whereby noting such variation(s).

As best shown in FIGS. 7, 8, and 9, the first side 331 of the hull engagement assembly 330 comprises a crossbar member 343 and an engaging member 335. Preferably, the crossbar member 343 is pivotally connected to the main body section 362 at the main body section inner end 364 and is pivotally connected to the support member 370 at the support member upper end 374. The engaging member 335 may be rotatably connected to the crossbar member 343 and disposed in a location adapted for engagement with the hull 313 of the watercraft 12. The crossbar member 343 may be adjustable in length, comprising telescoping members that can slide relative to one another, providing adjustability in the pivot angle of the support member 370 relative to the main body section 362. The crossbar member 343 is preferably formed of a suitable material having the general qualities and characteristics of being significantly immutable to deterioration that can be caused as a result of continuous immersion in a water environment in which the present invention is operated, such as stainless steel, aluminum, titanium or any suitable, sufficiently rigid polymeric or composite material (e.g., plastic, fiberglass, etc.).

The engaging member 335 preferably may comprise a pneumatic tire, solid microcellular tire (formed of nonmarking nylon or similar material), solid rubber roller or roller formed of other suitable material for maintaining frictional engagement with the hull 313 of the watercraft 12. The engaging member surface 341 is preferably substantially convex but may also be substantially flat or may be formed in other shapes suitable for maintaining frictional engagement between the engaging member surface 341 and the hull 313 of the watercraft 12.

Figure 13:
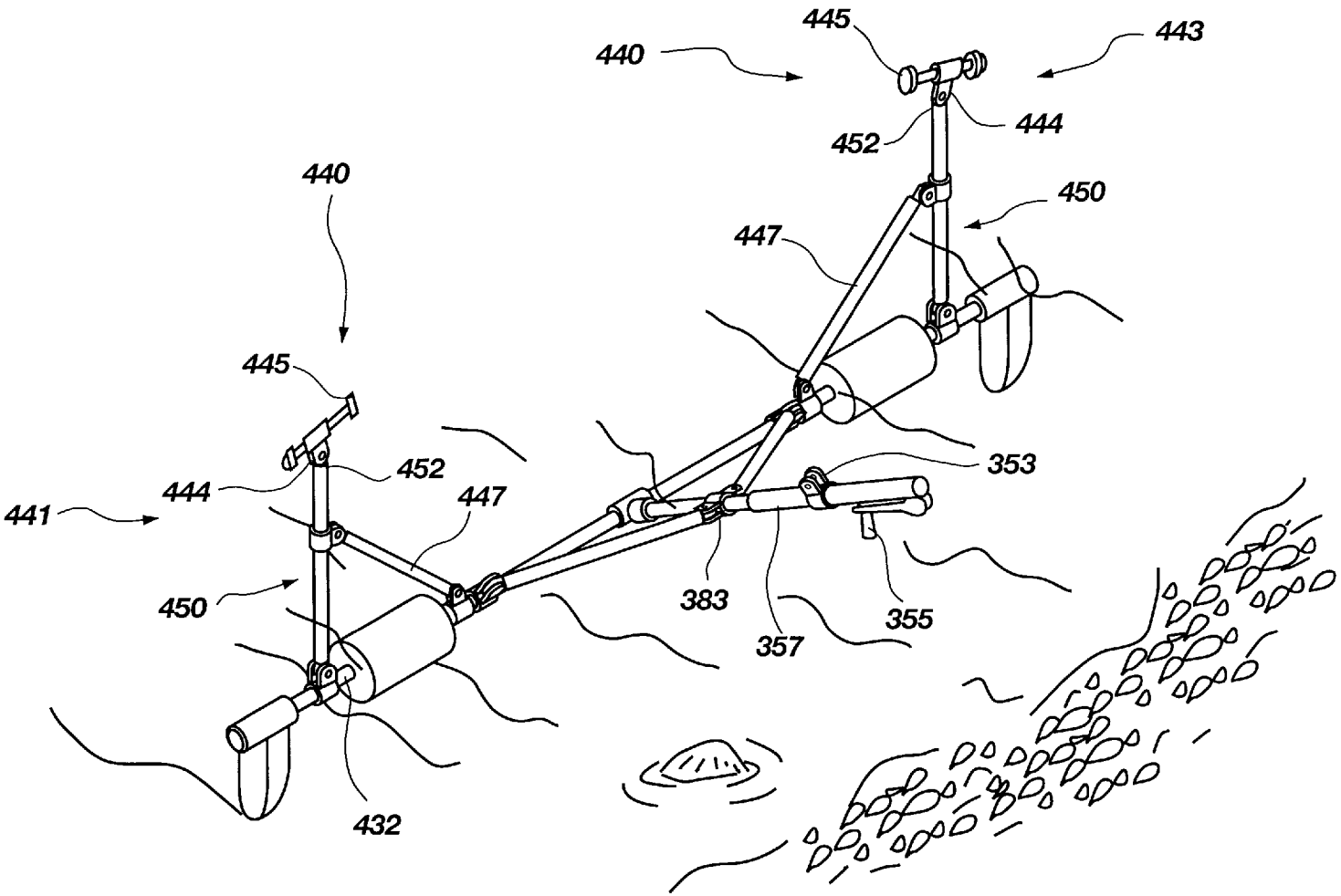
FIG. 13 is a perspective view of the embodiment of FIG. 7 illustrating a presently preferred alternate embodiment of the support member and the engaging member.
Figure 14:
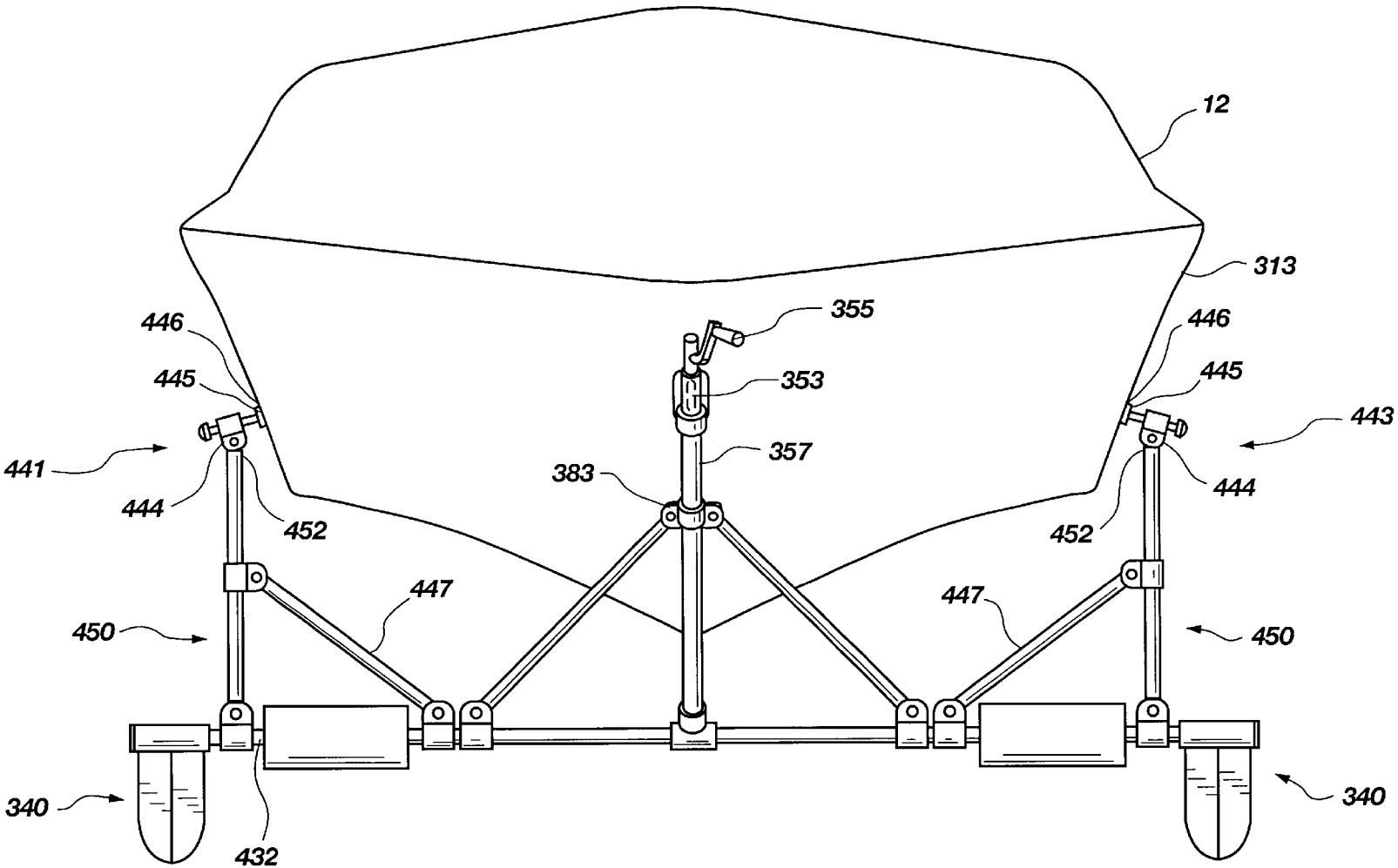
FIG. 14 is a front elevational view of the embodiment illustrated in FIG. 13 showing the engagement between the support members and engaging members with the hull of a watercraft.
Figure 15:
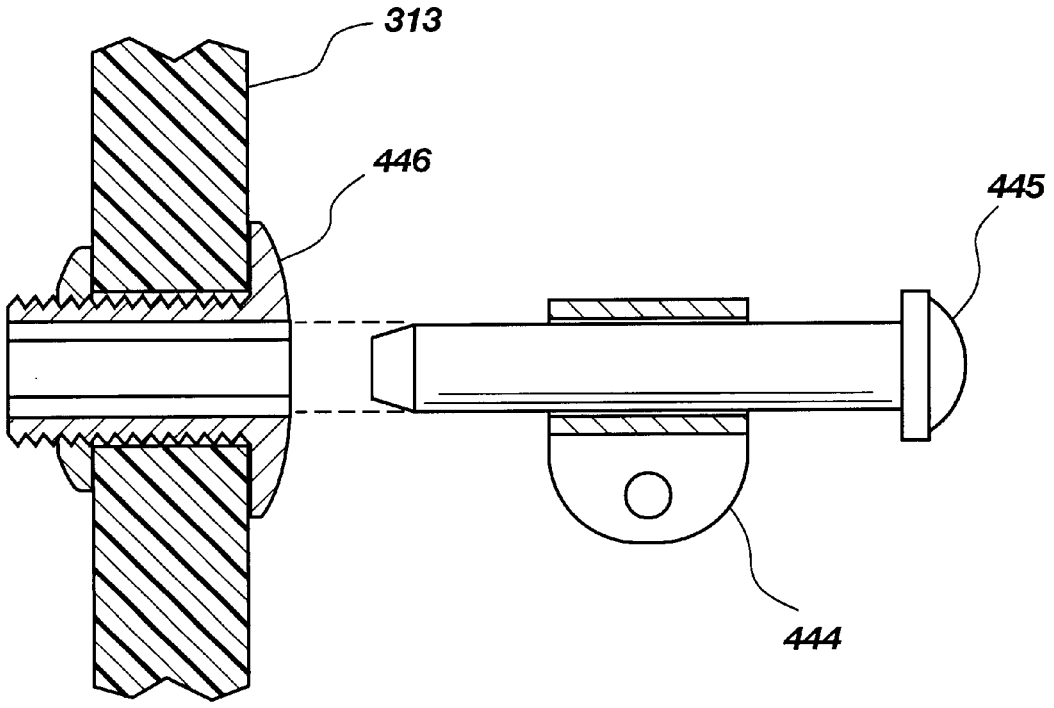
FIG. 15 is an exploded sectional view of the engaging member illustrated in FIGS. 13 and 14.

FIGS. 13, 14, and 15 illustrate an alternate preferred embodiment of the hull engagement assembly 440, which comprises a pivotal connection member 444 and engaging member 445. Preferably, the hull engagement assembly 440 may be formed having a first side 441 being disposed substantially parallel to a second opposing side 443, thereby providing a generally longitudinal alignment therebetween. Because the first side 441 and the second side 443 are constructed having a substantially comparable structure and configuration, only the first side 441 will be operatively disclosed in detail herein. Any structural variations(s) that exist between the first side 441 and the second opposing side 443 will be noted.

Preferably, the pivotal connection member 444 is rigidly connected to a support member 450 at the support member upper end 452. The engaging member 445 may be connected in any suitable manner to the pivotal connection member 444. In a conventional manner, the engaging member 445 may engage the hull 313 of the watercraft 12 by being connected to a hull mount 446 in the hull 313 of the watercraft 12, maintaining the hull 313 of the watercraft 12 in positive engagement with the support member 450. The watercraft 12 may be released from engagement with the portable support assembly by detaching the engaging member 445 from the hull mount 446, thus disengaging the hull engagement assembly 440 from positive engagement with the hull 313. The engaging member 445 may be connected to the hull mount 446 using any of a variety of engagement means well known by those skilled in the art, such as a twisting lock, screw threads, and the like.

The alternate preferred embodiment of the first side of the hull engagement assembly 440, may further comprise a stabilizing member 447 that is slidably connected to the main body section 432 and slidably connected to the support member 450. The slidable connectivity of stabilizing member 447 with both the support member 450 and main body section 432 provides adjustability in the pivot angle of the support member 450 relative to the main body section 432.

Based on the foregoing, it will be readily apparent that other mechanisms for engaging the watercraft 12 may be constructed in accordance with the inventive principles set forth herein. It is intended, therefore, that the examples provided herein be viewed as exemplary of the principles of the present invention, and not as restrictive to a particular structure for implementing those principles.

As best shown in FIGS. 7, 8, 9, 11, 13, and 14, the securing assembly 350 of one presently preferred embodiment is adapted to be moveable between a first position and a second position and comprises a marker 351, a securing connector 353, a motive device 355, a tongue 357, a tongue stand 359, and an adjustment assembly 380. The marker 351 may be connected to the tongue 357 and comprises a brightly colored flag or other suitable structure for identifying the location of the portable support assembly 310, especially when the portable support assembly 310 is substantially submerged under water. The securing connector 353 may be fastened to the tongue 357 and removably engages the bow eye 315, positively securing the watercraft 12 to the tongue 357. The tongue 357 may be pivotally connected to the main body 360 of the frame 320 at the point where the main body section 362 meets the opposing main body section 363. The tongue 357 may be formed from telescoping members that can slide relative to one another, enabling the tongue 357 to be moveable between a first position and a second position. The motive device 355 provides motive force to move the telescoping members of the tongue 357 between the first position and the second position. The tongue stand 359 provides support to maintain the tongue 357 above the surface flooring 14 of the body of water when not positively engaged with the watercraft 12.

The term "motive," as it relates to the present invention, is defined as of or relating to driving motion. The motive device 355 preferably comprises a screw drive but could also be a hydraulic drive, electric drive, winch drive or any other drive type suitable for moving the tongue 357 between the first position and the second position. The handle of the screw drive is preferably side mounted but may also be top mounted, or mounted in any other suitable location., The adjustment assembly 380 further comprises a pair of adjustment members 381, 382 a tongue connection member 383, and a pair of crossbar connection members 384, 385. The tongue connection member 383 may be slidably connected to the tongue 357 but includes a locking mechanism for fixing itself in known manner by pins or other means well known in the art at discrete points along the longitudinal extent of the tongue 357. The crossbar connection members 384, 385 may each be slidably connected to a respective crossbar member 343. Each crossbar connection member 384, 385 may also include a locking mechanism for fixing itself in known manner by pins or other means well known in the art at discrete points along the longitudinal extent of the respective crossbar members 343. Each of the adjustment members 381, 382 may be pivotally connected to the tongue connection member 383 and may be pivotally connected to one of the crossbar connection members 384, 385 such that the pair of adjustment members 381, 382 substantially form a "V" shape. Each of the adjustment members 381, 382 may be adjustable in length, comprising telescoping members that can slide relative to one another, providing adjustability in the pivot angle of the tongue 357 relative to the frame 320.

Based on the foregoing, it will be readily apparent that other mechanisms for securing the watercraft 12 to the portable support assembly 310 may be constructed in accordance with the inventive principles set forth herein. It is intended, therefore, that the examples provided herein be viewed as exemplary of the principles of the present invention, and not as restrictive to a particular structure for implementing those principles.

Figure 12:
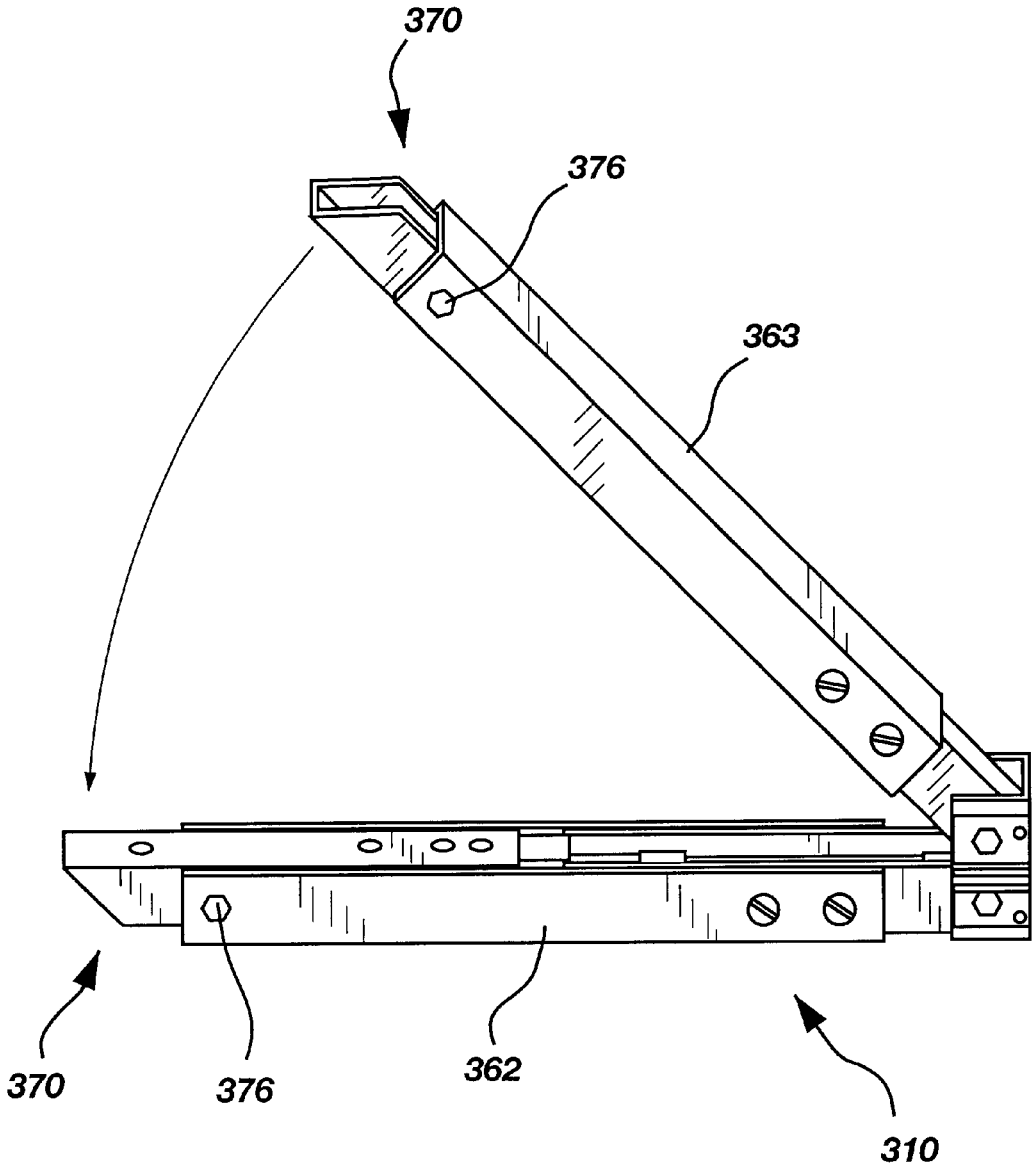
FIG. 12 is a perspective view of the embodiment of FIG. 7 in a semi-collapsed position in preparation for storage.

As shown in FIG. 12, the portable support assembly for watercraft 310 is preferably collapsible for portability and storage within a seat compartment of most watercraft. In an alternative embodiment, the portable support assembly 310 can be adapted to be permanently mounted to the hull of a watercraft.

Consistent with the foregoing, the adjustable functionality of the portable support assembly 310 provides a means for supporting various bow and keel configurations. As is readily apparent, the respective members of the portable support assembly may be adjusted in dimensional length and dimensional relation to one another. In the embodiment shown in FIGS. 7–12, the medial channel formed between the support members 370 by the crossbar members 343 and engaging members 335 can be adjusted from a low angle of about 5° to a high angle of about 75° in order to adjust for the various bow rises found in watercraft.

For example, the portable support assembly 310 can be adjusted to compensate for the contour of the floor surface of a body of water and present a medial channel formed between the support members 370 conforming to the bow degree and shape of the hull of a watercraft through the following actions, alone or in combination as required, adjusting the dimensional length of the main body 360, adjusting the dimensional length of the support members 370, adjusting the dimensional length of the crossbar members 343, and adjusting the dimensional length of the adjustment members 381, 382. Furthermore, adjustments can be made in the dimensional length of the tongue 357 and the dimensional length of the adjustment members 381, 382 to compensate for various positions of the bow eye 315 in relation to the hull of the watercraft 12.

In the embodiment shown in FIGS. 7, 8 and 9, the scale and adjustability of the portable support assembly 310 is variable to accommodate watercraft ranging from the smallest personal watercraft (i.e., jet skis, etc.) through boats of up to thirty (30) feet in length. For example, the adjustable length of respective members of the portable support assembly 310 of one presently preferred embodiment of the support assembly may include the following ranges: the main body 360, from thirty-two (32) to fifty-four (54) inches; the support members 370, from eight (8) to twenty (20) inches; the crossbar members 343, from twelve (12) to twenty-eight (28) inches; the tongue 357, from twenty (20) to fifty-six (56) inches, and the adjustment members 381, 382, from twelve (12) to thirty (30) inches. The engaging members 335 range in size from four (4) inches by three (3) inches to twelve (12) inches by six and one half (6.5) inches.

As appreciated by those skilled in the art, the dimensional scale of the portable support assembly 310 can be increased or decreased to accommodate larger watercraft or smaller watercraft, which would in turn increase or decrease the range of adjustability of the main body 360, the support members 370, the crossbar members 343, the tongue 357, and the adjustment members 381, 382. For example, the scale of the portable support assembly 310 could be increased to accommodate much larger watercraft, such as house boats, yachts or sea going vessels of any size. It is intended, therefore, that the examples, scales, dimensions, and ranges provided herein be viewed as exemplary of the principles of the present invention, and not as restrictive to a particular structure for implementing those principles.

In operation, as best shown in FIGS. 7, 8, 13 and 14, the portable support assembly for watercraft 310 is placed within a body of water at an appropriate depth in relation to the surface flooring 14. Appropriate adjustments may be made to the length of the respective members of the portable support assembly 310 to compensate for the contour of the surface flooring 14 of the body of water and present the hull engagement assembly 330 in a position adapted to receive and maintain supportable contact with the hull of a watercraft. A watercraft is then guided to the support assembly 310 by means of the marker 351 and maneuvered so that the keel of the watercraft is guided between the support members 370 and brought into engagement with the engaging members 335 of the hull engagement assembly 330.

A securing connector 353 may be disposed in relation to the bow eye of the watercraft and then the motive device 355 moves the tongue 357 of the securing assembly 350 from a first position toward the second position thereby pulling and lifting the leading end of the watercraft into supportable engagement with the portable support assembly 310. As the watercraft is pulled into supportable engagement with the support assembly, the weight of the watercraft resting on the support assembly urges the main body and retaining members of the support assembly into firm engagement with the surface flooring 14 of the body of water effectively fixing the watercraft in place. To disengage the watercraft from the portable support assembly, the motive device 355 moves the tongue 357 of the securing assembly 350 toward the first position thereby lowering the leading end of the watercraft out of supportable engagement with the portable support assembly 310. Finally, the securing connector 353 is removed from the bow eye of the watercraft thereby releasing the watercraft to move about the body of water. In its preferred embodiment, the portable support assembly 310 can then be collapsed into a compact configuration and stowed on board the watercraft.

FIGS. 16–19 show yet another presently preferred embodiment of the present invention. As shown, the alternate embodiment of the portable support assembly for watercraft 510 comprises a frame 520 for supporting a watercraft, a hull engagement assembly 530 for supportably engaging the watercraft 12, and a securing assembly 550 operably disposed in relation to the frame and including a securing connector 553 for removably engaging the watercraft.

In preferred construction, the frame 520 further comprises a main body 560 and at least two support members 570, connectably disposed at opposing ends of the main body 560. The main body 560 of the presently preferred alternate embodiment of the portable support assembly for watercraft 510 comprises a tubular configuration having openings formed at the first end 561 and second end 565 thereof having a sufficient diameter for introducing support members 570 therethrough. Because the support members 570 disposed at each of the opposing ends are substantially comparable in structure and configuration, only the support members 570 disposed at the first end 561 (the end distal in relation to the securing assembly 550) of the main body 560 will be disclosed in detail herein. Any structural variation(s) that exist between the support members 570 at the first end 561 and the support members 570 disposed at the second end 565 of the main body 560 will be noted.

Figure 16:
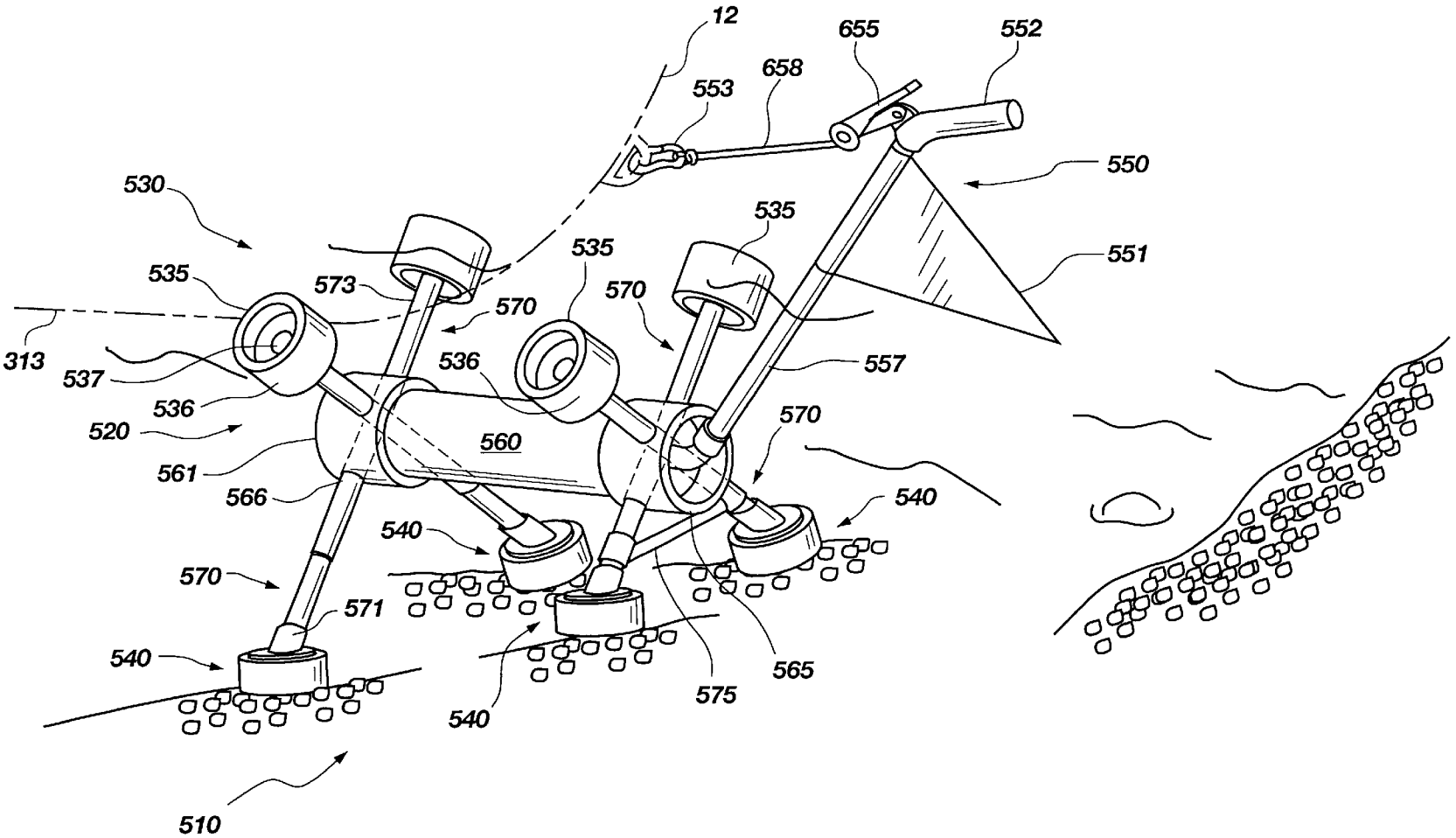
FIG. 16 is a perspective view of yet another presently preferred embodiment of the portable support assembly of the present invention.
Figure 17:
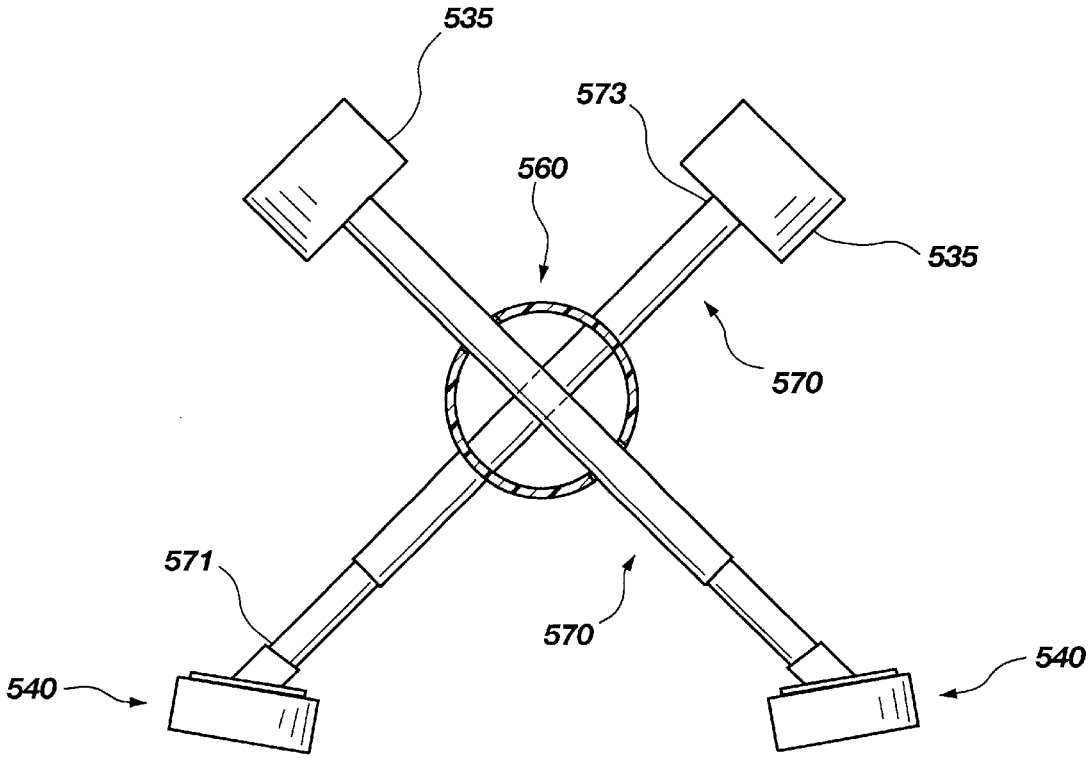
FIG. 17 is a sectional view of the embodiment of FIG. 16.

The two support members 570 disposed at the first end 561 of the main body 560 are preferably configured perpendicular to the axis of the main body 560. Similarly, the support members 570 are preferably disposed at approximately 45° angles to one another. As best illustrated in FIGS. 16 and 17, the two support members 570 are generally disposed having a substantially X-shaped configuration. The two support members 570 may also be disposed in a substantially M-shaped configuration at both the first end 561 and second end 565 of the main body 560. Alternatively, the support members 570 at the first end 561 of the main body 560 may be disposed having a to substantially X-shaped configuration and the support members 570 at the second end 565 of the main body 560 may be disposed having a substantially M-shaped configuration or vice versa. The foregoing examples are not intended to be exclusive and as appreciated by those skilled in the art, consistent with the inventive principles of the present invention, other configurations of the support members 570 may be used. Each of the support members 570 has a distal end 571 and a proximal end 573. The distal end 571 of each support member 570 extends substantially downwardly toward the surface flooring 14 of the body of water, and the proximal end 573 of each support member 570 extends substantially upwardly toward the hull 313 of the watercraft, when in use.

A restrictive sleeve may be incorporated to avoid the slippage of the support members 570 in relation to the openings formed at the first end 561 of the tubular configuration of the main body 560. Correspondingly, the use of a tubular configuration for the main body 560 may provide a means for removably introducing the other components of the portable support assembly 510 within its internal periphery for portability.

A body of water having a steep or convoluted surface flooring 14 can cause a problem in positioning of the support assembly 510 to maintain the hull engagement assembly 530 thereof in a substantially horizontal position for receiving the hull 313 of a watercraft. The support members 570 at the first end 561 of the main body 560 may be adjustable in length to accommodate for the contour of the surface flooring 14, providing adjustability in the height of the portable support assembly 510. Support members 570 at the first end 561 of the main body 560 may be telescoping type members wherein one member slips within the other and is secured in a fixed position at desired lengths in known manner by pins, retractable nubs, or other means well known in the art. In one presently preferred embodiment, round aluminum pipe may be utilized for the support members 570 at the first end 561 of the main body 560 with a smaller sized round pipe allowed to enter the cavity of the larger round pipe.

Because the surface flooring 14 of a body of water generally slopes as the water level gets deeper, it will be appreciated that the support members 570 disposed at the second end 565 of the main body 560 of the portable support assembly 510 have a dimensional length relatively shorter than the support members 570 disposed at the first end 561 of the main body 560. Accordingly, in the preferred embodiment, the support members 570 disposed at the second end 565 of the main body 560 are not adjustable in length. Telescoping, type members could, however, be substituted as support members 570 at the second end 565 of the main body 560 to make them adjustable in length, if desired. The dimensional relationship of the support members 570 at the first end 561 and second end 565 of the main body 560 of the portable support assembly 510 provide a means for assisting in the launching of an attached watercraft upon detachment.

A retaining member 540 may be formed at the distal end 571 of each of the support members 570 for restricting slippage of the portable support assembly 510 in relation to the surface flooring 14 (e.g., sand, mud, rock and/or a mixture) of a body of water. For example, a retaining member 540 at each of the distal ends 571 of the support members 570 may comprise a spike tip. Similarly, a retaining member 540 at each of distal ends 571 of the support members 570 could alternatively comprise an angular footing having means for resisting slippage of the support assembly 510. A flange may also be incorporated into the retaining member 540 to provide a means for restricting the insertion depth of the distal ends 571 of the support members 570 in relation to the surface flooring 14, if desired. Based on the foregoing, it will be readily apparent that other mechanisms for restricting slippage may be constructed in accordance with the inventive principles set forth herein. It is intended, therefore, that the examples provided herein be viewed as exemplary of the principles of the present invention, and not as restrictive to a particular structure for implementing those principles.

For example, each pair of support members 570 may also be linked together by a lateral member 575, welded at its two ends to each of the two support members 570 which would offer the following two advantages. First, the lateral member 575 would enable the user to deploy each pair of legs simultaneously, as opposed to deploying them individually, which would increase the speed of deployment of the device. Second, the two lateral members 575 serve to limit the depth to which the distal ends 571 of the support members 570 will sink into the around, thereby enhancing the stability of the portable support assembly 510.

The main body 560 and support members 570 may be formed of stainless steel, aluminum, titanium or any suitable, sufficiently rigid polymeric or composite material (e.g., plastic, fiberglass, etc.). In one presently preferred embodiment of the present invention, the main body 560 may be comprised of Yellow Mine™, which is typically stronger and lighter than conventional schedule 80 PVC.

Figure 18:
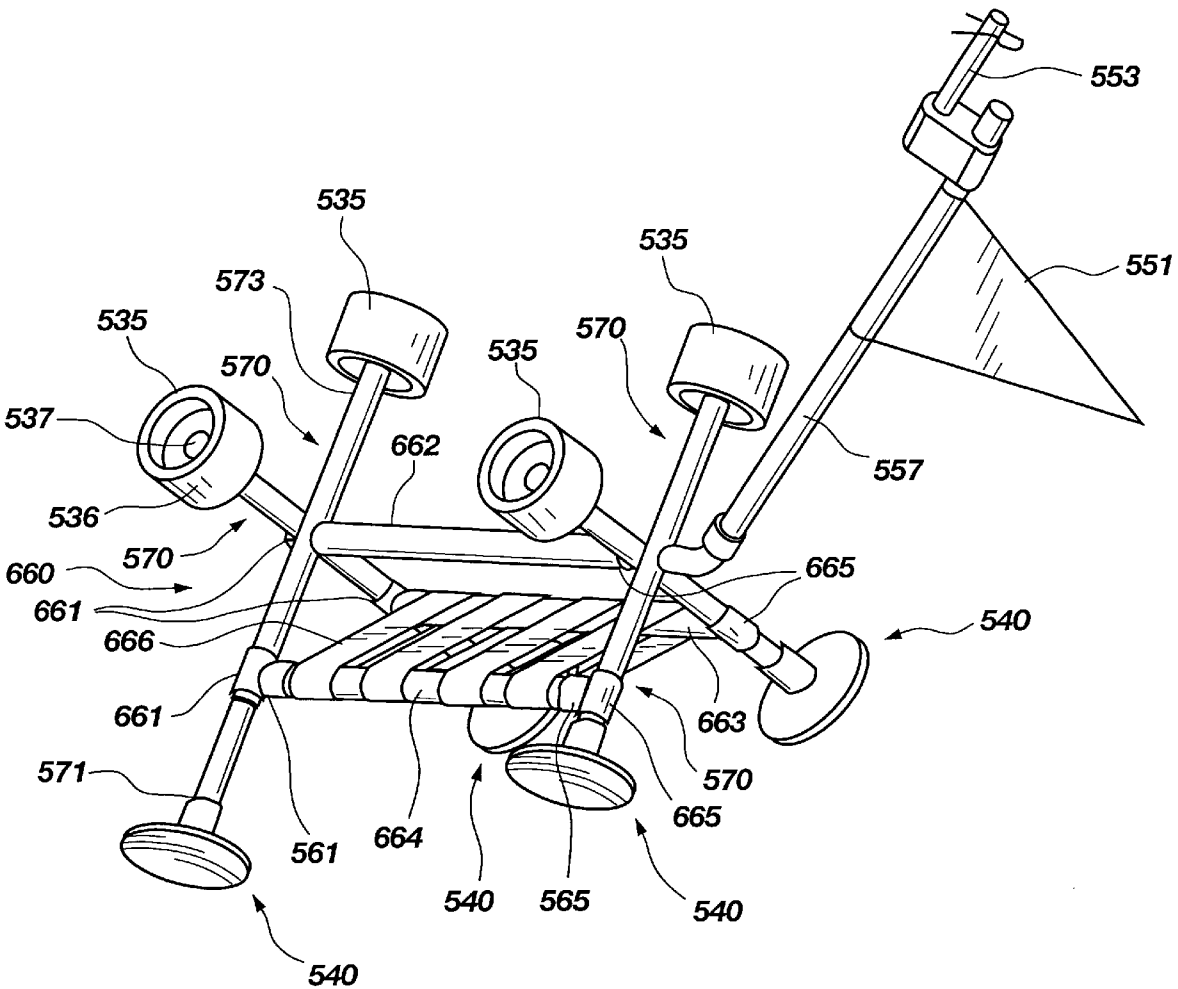
FIG. 18 is a perspective view of the embodiment of FIG. 16 illustrating an alternate embodiment of the main body portion of the support assembly.
Figure 19:
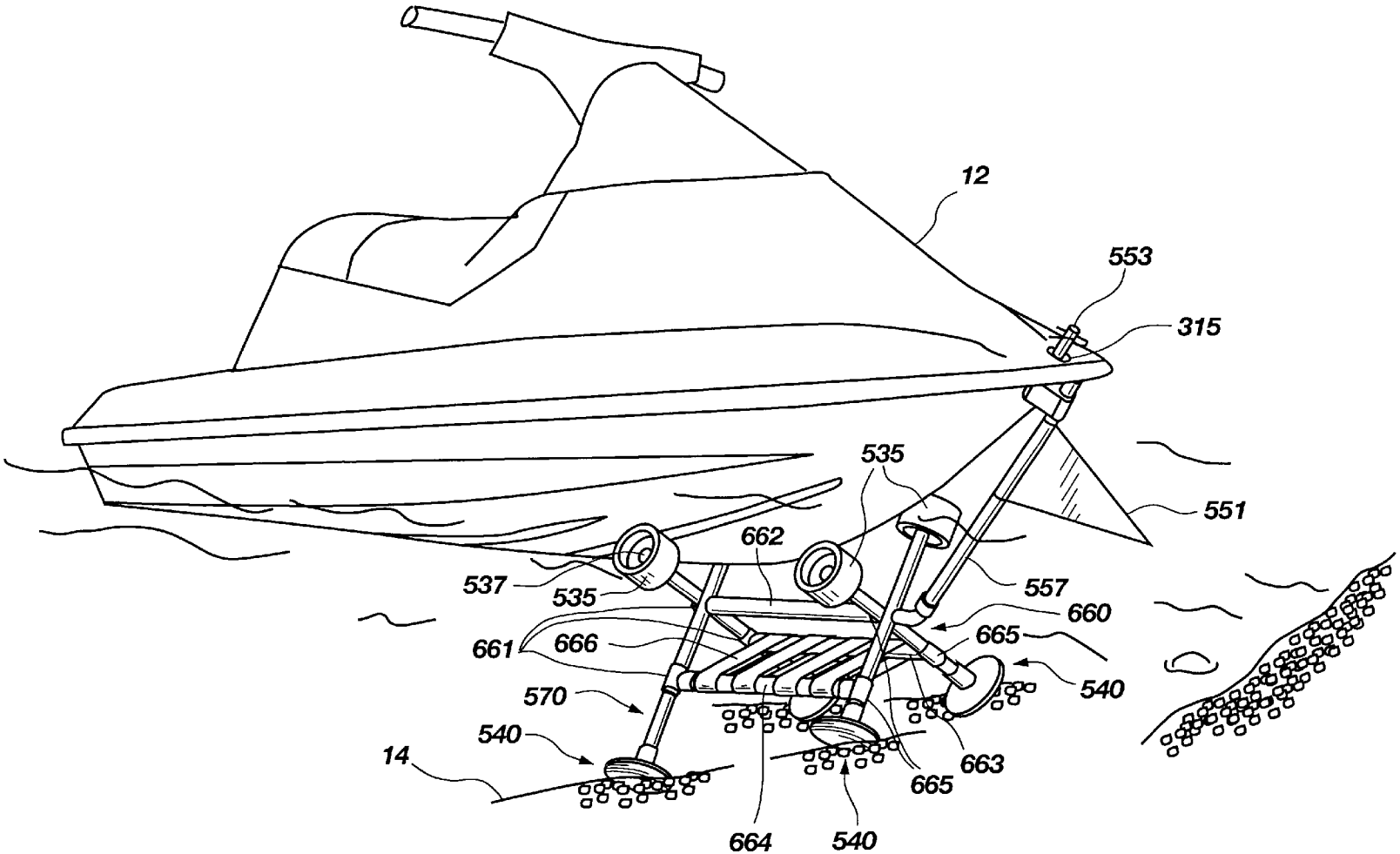
FIG. 19 is a perspective view of the embodiment of FIG. 18 illustrating a watercraft disposed in engagement with the portable support assembly.

FIGS. 18 and 19 illustrate an alternate preferred embodiment of the main body 660 of the embodiment of the portable support assembly 510 shown in FIGS. 16 and 17. As shown in FIGS. 18 and 19, the alternate embodiment of the main body 660 comprises three longitudinal members 662, 663, 664 and one or more binding straps 666. The first longitudinal member 662 may be moveably connected at the intersections formed in the pairs of support members 570 disposed at the first end 661 and second end 665 of the main body 660. The first end 661 of the second longitudinal member 663 of the main body 660 may be slidably connected along the longitudinal extent of one support member 570 disposed at the first end 661 of the main body 660 and the second end 665 of the second longitudinal member 663 of the main body 660 may be slidably connected along the longitudinal extent of a second support member 570 disposed at the second end 665 of the main body 660. The first end 661 of the third longitudinal member 664 of the main body 660 may be slidably connected along the longitudinal extent of the opposing support member 570 disposed at the first end 661 of the main body 660 and the second end 665 of the third longitudinal member 664 of the main body 660 may be slidably connected along the longitudinal extent of the opposing support member 570 disposed at the second end 665 of the main body 660. Although the first end 661 and second end 665 of the second longitudinal member 663 and third longitudinal member 664 may be slidably connected to the support members 570 at opposing ends of the main body 660, as described above, the slidable connections include locking mechanisms that operate to fix in known manner by pins or other means well known in the art the longitudinal members in position at desired locations along the longitudinal extent of the respective support members 570.

Each binding strap 666 comprises a closed member of substantially equal periphery. The binding straps 666 may be disposed about the second longitudinal member 663 and third longitudinal member 664, limiting the dimensional distance between the second longitudinal member 663 and third longitudinal member 664. The slidable attachment of the second longitudinal member 663 and third longitudinal member 664 with the pairs of support members 570 at the first end 661 and second end 665 of the main body 660 coupled with the limit on dimensional distance between the second longitudinal member 663 and third longitudinal member 664 imposed by the binding straps 666 provides adjustability of the size and angle of the medial channel for receiving the hull 313 of a watercraft 12 formed between the proximal ends 573 of the pairs of support members 570.

The hull engagement assembly 530 may be adapted to be connected to the support members 570. As shown in FIGS. 16–19, in a presently preferred embodiment, the hull engagement assembly 530 comprises at least four engaging members 535, one at the proximal end 573 of each support member 570. Each engaging member 535 may be connected to a proximal end 573 of a support member 570. Each engaging member 535 is preferably formed of a sufficiently sturdy material having a cushioned, non-abrasive or non-marring contact surface 536 and is preferably made of a corrosion-resistant material so as not to deteriorate rapidly due to exposure to the water and environment. For example, the engaging members 535 may be formed of urethane, rubber, or other suitable material.

Functionally, each engaging member 535 comprises an adjustable means for being supportably adjusted into various positions (e.g., conventional rocking/wobbling connection) relative to its structural relationship to the proximal end 573 of each support member 570. Each engaging member 535 may be adjusted approximately 7–10 degrees about its axis, preferably about 8–9 degrees in relation to each support member 570. In one presently preferred embodiment, the connection between each engaging member 535 and each support member 570 is maintained by a conventional gravity keeper or fastener (e.g., lock pin, wing nut, etc.). Consistent with the foregoing, the adjustable functionality of each of the engaging members 535 provides a means for supporting various bow and keel configurations.

In operation, the engaging members 535 guide the watercraft onto the portable support assembly 510 and, being positioned substantially as pairs, act to cushion the watercraft 12, while facilitating its movement onto the support assembly 510. Moreover, the engaging members 535 may be angled to conform to the dimensions of the hull 313 of the watercraft 12 and thereby urge the watercraft 12 toward a central, stable position.

In a presently preferred embodiment, the securing assembly 550 comprises a marker 551, a securing connector 553, and a tongue 557. The tongue 557 may be engageably disposed at a substantially perpendicular configuration in relation to the second end 565 of the main body 560 of the portable support assembly 510. The marker 551 (e.g., colored flag) is preferably connected to the tongue 557 to indicate the positioning or location of the portable support assembly 510. A handle 552 may also be disposed in relation to the tongue 557 to provide a means for assisting a user in manipulating the portable support assembly 510. The securing connector 553 may be disposed on the tongue 557 along the longitudinal extent thereof at a position adapted to enable the positive engagement of the securing connector 553 with the bow eye 315 of a watercraft resting on the hull engagement assembly 530 of the portable support assembly 510.

In an alternate presently preferred embodiment, the securing assembly 550 further comprises a securing strap 658 and a motive device 655. In this alternate embodiment, a first end of the securing strap 658 may be moveably connected to the motive device 655, and an opposing end of the securing strap 658 may be fixedly connected to the securing connector 553. The motive device 658 may be connected to the tongue 557 and may be adapted to pull the securing strap 658 taut after the securing connector 553 has been brought into positive engagement with the bow eye 315 of a watercraft 12 in order to assist in bringing the watercraft 12 into supportable engagement with the portable support assembly 510 and maintaining such supportable engagement. The motive device 655 may be a winch or any other known device for pulling taut the securing strap 658. The motive device 655 may be operated manually, electrically, hydraulically, or in any other suitable manner. The securing strap 658 may be formed of any suitable material, preferably resistant to deterioration caused by the watery environment. The motive device 655 and securing strap 658 may be disposed in relation to the tongue 557 in a posit;on to pull the watercraft 12 along a centerline of the portable support assembly 510. The engaging members 535 may be mounted on an angle to the main body 560 to assist in centering the watercraft 12 by engaging the hull 313 of the watercraft 12 and guiding it towards the centerline as it moves toward the tongue 557 at the second end 565 of the main body 560.

In operation, the embodiment of the portable support assembly 510 for watercraft shown in FIGS. 16–19 is placed within a body of water at an appropriate depth in relation to the surface flooring 14. Appropriate adjustments may be made to the length of the support members 570 at the first end 561 of the main body 560 to compensate for the contour of the surface flooring 14 of the body of water and present the hull engagement assembly 530 in a position adapted to receive and maintain supportable contact with the hull 313 of a watercraft 12. A watercraft 12 is guided to the support assembly 510 by means of the marker 551 and maneuvered so that the keel of the watercraft 12 is guided between the engaging members 535 toward the second end 565 of the main body 560 of the portable support assembly 510 to rest thereon, thereby lifting the leading end of the watercraft 12 into supportable engagement with the portable support assembly 510. To secure the relationship between the watercraft 12 and the portable support assembly 510 of the present invention, the securing connector 553 is disposed in relation to the bow eye 315 of the watercraft 12. The weight of the watercraft 12 resting on the support assembly 510 urges the retaining members 540 at the distal ends 571 of the respective support members 570 into firm engagement with the surface flooring 14 of the body of water effectively fixing or anchoring the watercraft 12 in place. To disengage the watercraft 12 from the portable support assembly 510, the securing connector 553 is removed from the bow eye 315 of the watercraft 12, and the keel of the watercraft 12 is guided between the engaging members 535 away from the portable support assembly 510 thereby releasing the watercraft 12 to move about the body of water. In its alternate preferred embodiment shown in FIGS. 16–19, the floating momentum of the watercraft is used to load and unload the watercraft therefrom (the alternate embodiment shown in FIGS. 16–19 does not lift the watercraft out of the water). A rider mounts the watercraft 12 and uses weight and momentum to release the watercraft 12 from the portable support assembly 510. The portable support assembly 510 can then be collapsed for ease of storage.

The alternate embodiment shown in FIGS. 16–19 enables relatively small watercraft such as, jet skis, wave runners, boats, and the like to be docked or rendered stationary in shallow water areas along shorelines. This allows the operators of small watercraft greater versatility in their choice of "port" sites, for the securing of the watercraft and loading and unloading of occupants and or materials from the craft.

From the above discussion, it will be appreciated that the present invention provides novel watercraft support apparatus comprising a means for avoiding damage (i.e., abrasive scratches in the hull, bow and/or keel) commonly associated with beaching a watercraft. The present invention generally fixes or anchors the watercraft in a single location with respect to the surface flooring of the body of water. The present invention further assists in supporting a portion of the weight of the watercraft and facilitates a stabilization force in the balance of the watercraft disposed in relation thereto to prevent it from rocking forward and backward and/or rolling onto either of its sides.

Unlike prior art devices, the present invention provides portable support apparatus for watercraft comprising a support member, an engaging member, and a securing assembly having the structural and functional capability of adjusting three dimensionally so as to conform to the configuration of the hull, keel and/or bow of a watercraft while accommodating for different rises in the hull. The present invention also includes a means for rendering both the portable support assembly and the watercraft stationary in the water, whereas docking of the watercraft to the portable support assembly does not require a strong upward thrust to lift the watercraft out of the water and into engagement with the support assembly. In particular, the securing assembly is generally used to compressively load the portable support assembly with respect to a surface flooring of a body of water, thereby rendering the portable support assembly and the watercraft stationary in the water.

Consistent with the foregoing, the present invention provides greater structural stability to a watercraft supportably disposed in relation thereto for purposes of providing a novel means for mooring the watercraft in relation to the surface flooring of a body of water without the fear of causing damage to the body of the watercraft. The present invention further provides a portable support assembly for watercraft that assists in supporting a portion of the weight of the watercraft and facilitates a stabilization in the balance of the watercraft disposed in relation thereto to inhibit the rocking forward and backward movement of the watercraft and/or rolling onto either of its sides. Similarly, the present invention has the structural and functional capability of adjusting three dimensionally so as to conform to the configuration of the hull, keel and/or bow of a watercraft, while accommodating for different rises in the hull of a watercraft, and for providing assistance in aligning the center line of the keel with the center of the support assembly. The portable support assembly for watercraft of the present invention also facilitates significant structural stability to the watercraft supportably disposed in relation thereto. Moreover, the present invention is lightweight, compact, easy to assemble and disassemble for purposes of portability and storage, effective in operation and commercially practical in view of being economical to manufacture.

The present invention may be embodied in other specific forms without departing from its spirit or essential characteristics. The described embodiments are to be considered in all respects only as illustrative, and not restrictive, The scope of the invention is, therefore, indicated by the appended claims, rather than by the foregoing description. All changes that come within the meaning and range of equivalency of the claims are to be embraced within their scope.

What is claimed and desired to be secured by United States Letters Patent is:

1. An apparatus for supporting a watercraft in relation to a surface flooring of a body of water, the apparatus comprising:

a support member for supporting the watercraft;

an engaging member adapted to be connected to the support member to selectively retain the watercraft in relation to the support member; and a securing assembly having a first end configured to engage the support member, a second end configured to operably engage the watercraft, and a resilient intermediate body disposed between the first and second ends, wherein the securing assembly is configured to provide a dynamic compressive load on the support member.

2. An apparatus for supporting a watercraft as defined in claim 1, further comprising a retaining member connected to the support member for retaining the support member in relation to the surface flooring.

3. An apparatus for supporting a watercraft as defined in claim 2, wherein the retaining member comprises a structural configuration being selected from a group consisting of a flat surface, a concave surface, an angled surface, a spade, a spike, a flange, a cup, and a wheel.

4. An apparatus for supporting a watercraft as defined in claim 1, wherein the support member comprises a substantially rigid construction.

5. An apparatus for supporting a watercraft as defined in claim 1, wherein the support member is adapted to be oriented in a substantially vertical position in relation to the watercraft when disposed in engagement with the engaging member.

6. An apparatus for supporting a watercraft as defined in claim 1, wherein the support member comprises at least two members, a first one of the two members including a connector adapted for connecting to the second one of the two members.

7. An apparatus for supporting a watercraft as defined in claim 6, wherein the connector comprises a screw-type connection.

8. An apparatus for supporting a watercraft as defined in claim 1, wherein the support member comprises at least two members disposed in telescopic engagement.

9. An apparatus for supporting a watercraft as defined in claim 1, wherein the support member is pivotally connected to the engaging member.

10. An apparatus for supporting a watercraft as defined in claim 1, wherein the securing assembly is moveable between a first position and a second position.

11. An apparatus for supporting a watercraft as defined in claim 1, wherein the engaging member comprises a retaining aperture selectively mounted in relation to the watercraft and adapted to engageably receive the support member.

12. An apparatus for supporting a watercraft as defined in claim 11, wherein the retaining aperture is formed in a swimming platform connected to the watercraft.

13. An apparatus for supporting a watercraft as defined in claim 11, wherein the watercraft comprises a hull, the retaining aperture being formed in at least a portion of the hull.

14. An apparatus for supporting a watercraft as defined in claim 11, wherein the watercraft comprises a bow, the retaining aperture being formed in at least a portion of the bow.

15. An apparatus for supporting a watercraft as defined in claim 1, further comprising a mounting aperture adapted to selectively receive the engaging member in connection therewith.

16. An apparatus for supporting a watercraft as defined in claim 1, wherein the engaging member includes a fixation member for fixing the support member at a substantially vertical position corresponding to a determinable depth to which the support member extends substantially downward in relation to the watercraft.

17. An apparatus for supporting a watercraft as defined in claim 1, wherein the securing assembly comprises a tension adjuster for adjusting a compressive load acting on the support member.

18. An apparatus for supporting a watercraft as defined in claim 17, wherein the tension adjuster comprises a strap, a fastener configured to engage the strap, and a biasing spring adapted to apply a constant dynamic force to the support member.

19. An apparatus for supporting a watercraft in relation to a surface flooring of a body of water, the apparatus comprising:

a support member for supporting the watercraft;

an engaging member adapted to be connected to the support member to selectively retain the watercraft in relation to the support member;

a retaining member disposed in relation to the support member for retaining the support member in relation to the surface flooring; and a securing assembly having a first end configured to engage the support member, a second end configured to operably engage the watercraft, and a resilient intermediate body disposed between the first and second ends, the securing assembly further comprising a tension adjuster for adjusting a dynamic compressive load on the support member.

20. An apparatus for supporting a watercraft as defined in claim 19, wherein the support member comprises a substantially rigid construction.

21. An apparatus for supporting a watercraft as defined in claim 19, wherein the support member is adapted to be oriented in a substantially vertical position in relation to the watercraft when disposed in engagement with the engaging member.

22. An apparatus for supporting a watercraft as defined in claim 19, wherein the support member comprises at least two members, a first one of the two members including a connector adapted for connecting to the second one of the two members.

23. An apparatus for supporting a watercraft as defined in claim 22, wherein the connector comprises a screw-type connection.

24. An apparatus for supporting a watercraft as defined in claim 19, wherein the support member comprises at least two members disposed in telescopic engagement.

25. An apparatus for supporting a watercraft as defined in claim 19, wherein the support member is pivotally connected to the engaging member.

26. An apparatus for supporting a watercraft as defined in claim 19, wherein the retaining member comprises a structural configuration being selected from a group consisting of a flat surface, a concave surface, an angled surface, a spade, a spike, a flange, a cup, and a wheel.

27. An apparatus for supporting a watercraft as defined in claim 19, wherein the securing assembly is moveable between a first position and a second position.

28. An apparatus for supporting a watercraft as defined in claim 19, wherein the engaging member comprises a retaining aperture selectively mounted in relation to the watercraft and adapted to engageably receive the support member.

29. An apparatus for supporting a watercraft as defined in claim 28, wherein the retaining aperture is formed in a swimming platform connected to the watercraft.

30. An apparatus for supporting a watercraft as defined in claim 28, wherein the watercraft comprises a hull, the retaining aperture being formed in at least a portion of the hull.

31. An apparatus for supporting a watercraft as defined in claim 28, wherein the watercraft comprises a bow, the retaining aperture being formed in at least a portion of the bow.

32. An apparatus for supporting a watercraft as defined in claim 19, further comprising a mounting aperture adapted to selectively receive the engaging member in connection therewith.

33. An apparatus for supporting a watercraft as defined in claim 19, wherein the engaging member includes a fixation member for fixing the support member at a substantially vertical position corresponding to a determinable depth to which the support member extends substantially downward in relation to the watercraft.

34. An apparatus for supporting a watercraft as defined in claim 19, wherein the tension adjuster comprises a strap, a fastener configured to engage the strap, and a spring adapted to apply a constant dynamic force on the support member to retain the retaining member in engagement with the surface.

* * * * *

UNITED STATES PATENT AND TRADEMARK OFFICE

CERTIFICATE OF CORRECTION

PATENT NO. : 6,273,016 B1
DATED : August 14, 2001
INVENTOR(S) : Gibbs

It is certified that error appears in the above-identified patent and that said Letters Patent is hereby corrected as shown below:

Column 7,
Line 2, after “Thus”, please insert -- , --.
Line 11, after “out”, please insert -- . --.

Column 10,
Line 14, after “may”, please insert -- be --.

Column 11,
Line 10, after “then”, please insert -- be --.

Column 12,
Line 8, please delete “water”, and insert therefor -- watercraft --.
Line 53, please delete “0”, and insert therefor -- 10 --.

Column 13,
Line 19, please delete “variations”, and insert therefor -- variation --.
Line 23, please delete “an”.

Column 14,
Lines 20 and 65, please delete “variations”, and insert therefor -- variation --.
Line 24, please delete “8, and”, and insert therefor -- 8, 9, and 11, --.

Column 18,
Line 32, please delete “to”.

Column 19,
Line 14, after “Telescoping”, please delete “,” .
Line 53, please delete “around” and insert therefor -- ground --.

Column 21,
Line 50, please delete “posit;on,” and insert therefor -- position --.

UNITED STATES PATENT AND TRADEMARK OFFICE

CERTIFICATE OF CORRECTION

PATENT NO. : 6,273,016 B1
DATED : August 14, 2001
INVENTOR(S) : Gibbs

It is certified that error appears in the above-identified patent and that said Letters Patent is hereby corrected as shown below:

Column 23,
Line 25, after "restrictive" please insert -- . --.

Signed and Sealed this

Twentieth Day of May, 2003

JAMES E. ROGAN
*Director of the United States Patent and Trademark Office*